US012760636B2

(12) United States Patent
LaCroix et al.

(10) Patent No.: US 12,760,636 B2
(45) Date of Patent: Oct. 13, 2026

(54) AUTOMATED DIRECTIONAL DRILLING CONTROL SYSTEM

(71) Applicant: Nabors Drilling Technologies USA, Inc., Houston, TX (US)

(72) Inventors: Adam LaCroix, Cypress, TX (US); Trey Welch, Conroe, TX (US); Sachitananda Maddikunta, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 19/054,260

(22) Filed: Feb. 14, 2025

(65) Prior Publication Data

US 2025/0264016 A1 Aug. 21, 2025

Related U.S. Application Data

(60) Provisional application No. 63/554,083, filed on Feb. 15, 2024.

(51) Int. Cl.

| | |
|---|---|
| ***E21B 44/04*** | (2006.01) |
| ***E21B 7/04*** | (2006.01) |
| ***E21B 45/00*** | (2006.01) |

(52) U.S. Cl.

CPC ..... *E21B 44/04* (2013.01); *E21B 7/046* (2013.01); *E21B 45/00* (2013.01)

(58) Field of Classification Search

CPC ..... E21B 44/04; E21B 7/046

See application file for complete search history.

(56) References Cited

U.S. PATENT DOCUMENTS

| | | | |
|---|---|---|---|
| 2019/0048707 | A1 | 2/2019 | Benson et al. |
| 2019/0353024 | A1 | 11/2019 | Papouras et al. |
| 2023/0417134 | A1 | 12/2023 | Neufeldt et al. |

OTHER PUBLICATIONS

Coffey Scott, et al.; "Improvements in Slide Quality and Execution Speed Through Automation;" 2019 AADE National Technical Conference; Apr. 9, 2019; pp. 1-10.

*Primary Examiner* — Giovanna Wright

(74) *Attorney, Agent, or Firm* — Haynes and Boone, LLP

(57) ABSTRACT

Systems and methods for an automated directional drilling control system including a programmable logic computer ("PLC") configured with one or more constraint and configured to calculate one or more metrics to automatically adjust drilling parameter setpoints to optimize performance. During performance of a first portion of a slide drill segment, the automated directional drilling control system is configured to maximize a rate of penetration ("ROP") while maintaining a desired slide score. After one or more conditions are met during the first portion of the slide drill segment, a second portion of the slide drill segment is performed during which the automated directional drilling control system controls either a ROP setpoint parameter or a weight on bit ("WOB") setpoint parameter while floating the setpoint of the non-controlling parameter at a value above its current average value. The selection of the controlling parameter can be toggled back and forth manually or automatically.

22 Claims, 11 Drawing Sheets

AUTOMATED DIRECTIONAL DRILLING CONTROL SYSTEM

CROSS-REFERENCE TO RELATED APPLICATION

This application claims priority to and the benefit of the filing date of U.S. Provisional Application No. 63/554,083, filed Feb. 15, 2024, the entire disclosure of which is hereby incorporated herein by reference.

FIELD OF THE DISCLOSURE

The present disclosure relates, in general, to an automated directional drilling control system, and more particularly, to an automated directional drilling control system configured to automatically adjust drilling parameter setpoints to optimize performance.

BACKGROUND

Current directional drilling control systems rely on human intervention to operate and manually adjust drilling parameter setpoints. The method in which drilling parameters are adjusted during drilling operations, such as slide drilling operations, can significantly impact rate of penetration ("ROP") and tool face control, both of which ultimately affect the quality and efficiency of the drilling operation. When such drilling parameters are adjusted manually by one or more operators, variations in operator skill and competency can contribute to inconsistencies in the quality and efficiency of the drilling operation and human error can result in damage to a bottom hole assembly, all of which can contribute to increased costs and delays associated with the drilling operation.

The present disclosure introduces improved methods and systems for automatically adjusting directional drilling parameter setpoints to optimize performance.

DETAILED DESCRIPTION

The systems and methods disclosed herein provide improvements to the methods and system used for directional drilling in oil and gas drilling operations. It is to be understood that the present disclosure provides many different embodiments, or examples, for implementing different features of various embodiments. Specific examples of components and arrangements are described below to simplify the present disclosure. These are, of course, merely examples and are not intended to be limiting.

Figure 1:
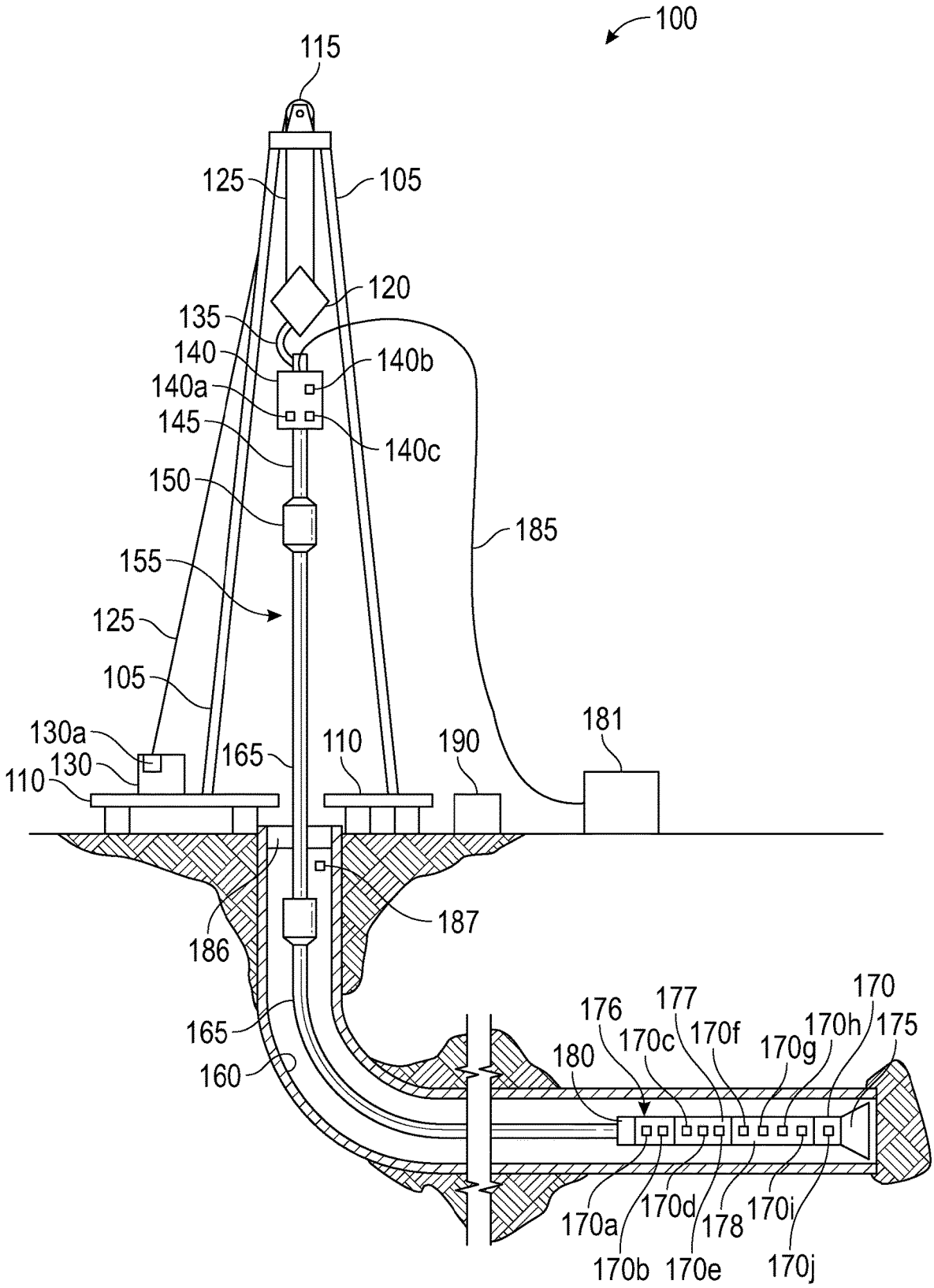
FIG. 1 illustrates a drilling apparatus, according to one or more embodiments of the present disclosure.

FIG. 1 illustrates a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Generally, the apparatus 100 monitors, in real-time, drilling operations relating to a wellbore and creates and/or modifies drilling instructions based on the monitored drilling operations. As used herein, the term "real-time" is thus meant to encompass close to real-time, such as within about 10 seconds, preferably within about 5 seconds, and more preferably within about 2 seconds. "Real-time" can also encompass an amount of time that provides data based on a wellbore drilled to a given depth to provide actionable data according to the present invention before a further wellbore being drilled achieves that depth.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to draw works 130, which is configured to reel out and reel in the drilling line 125 to cause the traveling block 120 to be lowered and raised relative to the rig floor 110. The draw works 130 may include a rate of penetration ("ROP") sensor 130*a*, which is configured for detecting an ROP value or range, and a controller to feed-out and/or feed-in of a drilling line 125. The other end of the drilling line 125, known as a dead line anchor, is anchored to a fixed position, possibly near the draw works 130 or elsewhere on the rig.

A hook 135 is attached to the bottom of the traveling block 120. A top drive 140 is suspended from the hook 135. A quill 145, extending from the top drive 140, is attached to a saver sub 150, which is attached to a drill string 155 suspended within a wellbore 160. Alternatively, the quill 145 may be attached to the drill string 155 directly.

The term "quill" as used herein is not limited to a component which directly extends from the top drive 140, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe or tubulars 165 and a BHA 170, which includes a drill bit 175. The BHA 170 may include one or more measurement-while-drilling ("MWD") or wireline conveyed instruments 176, flexible connections 177, motors 178, bent housing and bent subs for point-the-bit drilling, a controller 180, stabilizers, and/or drill collars, among other components. One or more pumps 181 may deliver drilling fluid to the drill string 155 through a hose or other conduit 185, which may be connected to the top drive 140.

The downhole MWD or wireline conveyed instruments 176 may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, sent to the controller 180, and downloaded from the instrument(s) at the surface and/or transmitted real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, and/or transmission as electromagnetic pulses. The MWD tools and/or other portions of the BHA 170 may have the ability to store measurements for later retrieval via wireline and/or when the BHA 170 is tripped out of the wellbore 160.

In an example embodiment, the apparatus 100 may also include a rotating blow-out preventer ("BOP") 186, such as if the wellbore 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 186. The apparatus 100 may also include a surface casing annular pressure sensor 187 configured to detect the pressure in the annulus defined between, for example, the wellbore 160 (or casing therein) and the drill string 155. It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

In the example embodiment depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 may include a downhole annular pressure sensor **170*a* coupled to or otherwise associated with the BHA 170. The downhole annular pressure sensor 170*a* may be configured to detect a pressure value or range in the annulus-shaped region defined between the external surface of the BHA 170 and the internal diameter of the wellbore 160**, which may also be referred to as the casing pressure, downhole casing pressure, MWD casing pressure, or downhole annular pressure. These measurements may include both static annular pressure (pumps off) and active annular pressure (pumps on). However, in other embodiments the downhole annular pressure may be calculated using measurements from a plurality of other sensors located downhole or at the surface of the well.

The apparatus 100 may additionally or alternatively include a shock/vibration sensor **170*b* that is configured for detecting shock and/or vibration in the BHA 170. The apparatus 100 may additionally or alternatively include a mud motor delta pressure ($\Delta P$) sensor 170*c* that is configured to detect a pressure differential value or range across the one or more motors 178 of the BHA 170. In some embodiments, the mud motor $\Delta P$ may be alternatively or additionally calculated, detected, or otherwise determined at the surface, such as by calculating the difference between the surface standpipe pressure just off-bottom and pressure once the bit touches bottom and starts drilling and experiencing torque. The one or more motors 178 may each be or include a positive displacement drilling motor that uses hydraulic power of the drilling fluid to drive the bit 175, also known as a mud motor. One or more torque sensors, such as a bit torque sensor, may also be included in the BHA 170 for sending data to a controller 190 that is indicative of the torque applied to the bit 175**.

The apparatus 100 may additionally or alternatively include a toolface sensor **170*e* configured to estimate or detect the current toolface orientation or toolface angle. The toolface sensor 170*c* may be or include a conventional or future-developed gravity toolface sensor which detects toolface orientation relative to the Earth's gravitational field. Alternatively, or additionally, the toolface sensor 170*c* may be or include a conventional or future-developed magnetic toolface sensor which detects toolface orientation relative to magnetic north or true north. However, other toolface sensors may also be utilized within the scope of the present disclosure, including non-magnetic toolface sensors and non-gravitational inclination sensors. The toolface sensor 170*c* may also, or alternatively, be or include a conventional or future-developed gyro sensor. The apparatus 100 may additionally or alternatively include a WOB sensor 170*f* integral to the BHA 170 and configured to detect WOB at or near the BHA 170. The apparatus 100 may additionally or alternatively include an inclination sensor 170*g* integral to the BHA 170 and configured to detect inclination at or near the BHA 170. The apparatus 100 may additionally or alternatively include an azimuth sensor 170*h* integral to the BHA 170 and configured to detect azimuth at or near the BHA 170. The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140***b* configured to detect a value or range of the rotational speed of the quill 145. In some embodiments, the BHA 170 also includes another directional sensor 170*i* (e.g., azimuth, inclination, toolface, combination thereof, etc.) that is spaced along the BHA 170 from a first directional sensor (e.g., the inclination sensor 170*g*, the azimuth sensor 170*h*). For example, and in some embodiments, the sensor 170*i* is positioned in the MWD 176 and the first directional sensor is positioned along another portion of the BHA 170, with a known distance between them, for example 20 feet, configured to estimate or detect the current toolface orientation or toolface angle. The sensors 170*a*-170*j* are not limited to the arrangement illustrated in FIG. 1 and may be spaced along the BHA 170 in a variety of configurations.

The top drive 140, the draw works 130, the crown block 115, the traveling block 120, drilling line or dead line anchor may additionally or alternatively include or otherwise be associated with a WOB or hook load sensor 140*c* (WOB calculated from the hook load sensor that can be based on active and static hook load) (e.g., one or more sensors installed somewhere in the load path mechanisms to detect and calculate WOB, which can vary from rig-to-rig) different from the WOB sensor 170*f*. The WOB sensor 140*f* may be configured to detect a WOB value or range, where such detection may be performed at the top drive 140, the draw works 130, or other component of the apparatus 100. Generally, the hook load sensor 140*c* detects the load on the hook 135 as it suspends the top drive 140 and the drill string 155.

The detection performed by the sensors described herein may be performed once, continuously, periodically, and/or at random intervals. The detection may be manually triggered by an operator or other person accessing a human-machine interface ("HMI") or GUI, or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the system.

In some embodiments, the controller 180 is configured to control or assist in the control of one or more components of the apparatus 100. For example, the controller 180 may be configured to transmit operational control signals to the controller 190, the draw works 130, the top drive 140, other components of the BHA 170, and/or the pump 181. The controller 180 may be a stand-alone component that forms a portion of the BHA 170 or be integrated in another sensor that forms a portion of the BHA 170. The controller 180 may be configured to transmit the operational control signals or instructions to the draw works 130, the top drive 140, other components of the BHA 170, and/or the pump 181 via wired or wireless transmission means which, for the sake of clarity, are not depicted in FIG. 1.

The apparatus 100 also includes the controller 190, which is or forms a portion of a computing system, configured to control or assist in the control of one or more components of the apparatus 100. For example, the controller 190 may be configured to transmit operational control signals to the draw works 130, the top drive 140, the BHA 170 and/or the pump 181. The controller 190 may be a stand-alone component installed near the mast 105 and/or other components of the apparatus 100. In an example embodiment, the controller 190 includes one or more systems located in a control room proximate the mast 105, such as the general-purpose shelter often referred to as the "doghouse" serving as a combination tool shed, office, communications center, and general meeting place. The controller 190 may be configured to transmit the operational control signals to the draw works 130, the top drive 140, the BHA 170, and/or the pump 181 via wired or wireless transmission means which, for the sake of clarity, are not depicted in FIG. 1.

In some embodiments, the controller 190 is not operably coupled to the top drive 140, but instead may include other drive systems, such as a power swivel, a rotary table, a coiled tubing unit, a downhole motor, and/or a conventional rotary rig, among others.

In some embodiments, the controller 190 controls the flow rate and/or pressure of the output of the mud pump 181.

In some embodiments, the controller 190 controls the feed-out and/or feed-in of the drilling line 125, rotational control of the draw works (in v. out) to control the height or position of the hook 135 and may also control the rate the hook 135 ascends or descends. However, example embodiments within the scope of the present disclosure include those in which the draw-works-drill-string-feed-off system may alternatively be a hydraulic ram or rack and pinion type hoisting system rig, where the movement of the drill string 155 up and down is via something other than the draw works 130. The drill string 155 may also take the form of coiled tubing, in which case the movement of the drill string 155 in and out of the hole is controlled by an injector head which grips and pushes/pulls the tubing in/out of the hole. Nonetheless, such embodiments may still include a version of the draw works controller, which may still be configured to control feed-out and/or feed-in of the drill string 155.

Generally, the apparatus 100 also includes a hook position sensor that is configured to detect the vertical position of the hook 135, the top drive 140, and/or the travelling block 120. The hook position sensor may be coupled to, or be included in, the top drive 140, the draw works 130, the crown block 115, and/or the traveling block 120 (e.g., one or more sensors installed somewhere in the load path mechanisms to detect and calculate the vertical position of the top drive 140, the travelling block 120, and the hook 135, which can vary from rig-to-rig). The hook position sensor is configured to detect the vertical distance the drill string 155 is raised and lowered, relative to the crown block 115. In some embodiments, the hook position sensor is a draw works encoder, which may be the ROP sensor 130*a*. In some embodiments, the apparatus 100 also includes a rotary RPM sensor that is configured to detect the rotary RPM of the drill string 155. This may be measured at the top drive 140 or elsewhere, such as at surface portion of the drill string 155. In some embodiments, the apparatus 100 also includes a quill position sensor that is configured to detect a value or range of the rotational position of the quill 145, such as relative to true north or another stationary reference. In some embodiments, the apparatus 100 also includes a pump pressure sensor that is configured to detect the pressure of mud or fluid that powers the BHA 170 at the surface or near the surface. In some embodiments, the apparatus also includes a MSE sensor that is configured to detect the MSE representing the amount of energy required per unit volume of drilled rock. In some embodiments, the MSE is not directly sensed, but is calculated based on sensed data at the controller 190 or other controller. In some embodiments, the apparatus 100 also includes a bit depth sensor that detects the depth of the bit 175.

In one or more embodiments, the apparatus 100 may be utilized for directional drilling using a bent sub. Directional drilling includes both rotating drilling and slide drilling.

During rotating drilling, the entire drill string 155, including the bent sub, is rotated using the top drive 140. Rotating drilling is typically used for vertical drilling (or "building"). During slide drilling, rotation of the drill string 155 is stopped, weight is applied to the drill bit 175, and the motors 178 associated with the BHA 170 rotate the drill bit 175 while pointed, using the bent sub, in a direction to steer the bit 175 and well bore.

Figure 2:
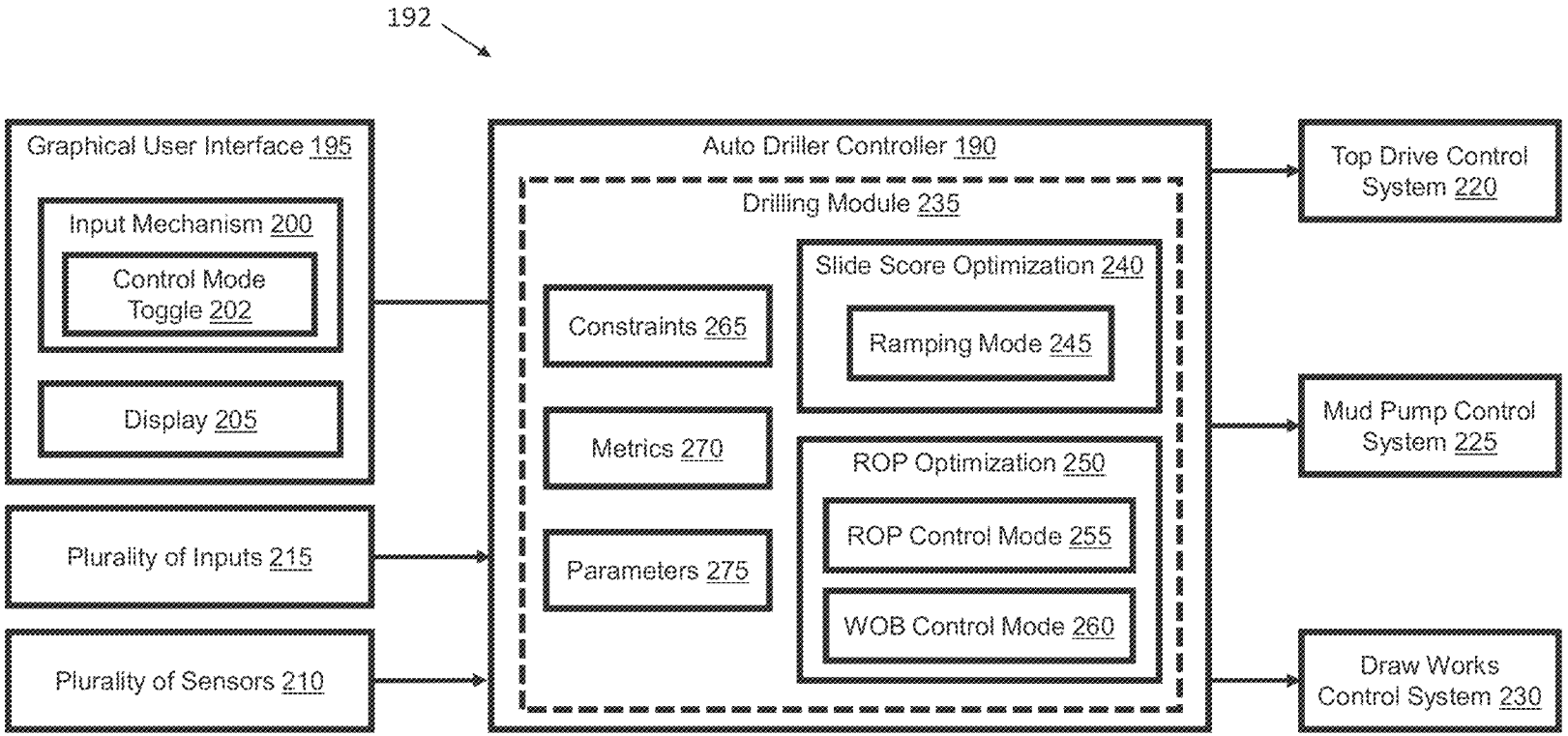
FIG. 2 illustrates an automated directional drilling control system including one or more components of the drilling apparatus of FIG. 1, according to one or more embodiments of the present disclosure.

FIG. 2 is a diagrammatic illustration of a data flow for an automated directional control system 192 involving at least a portion of the apparatus 100, according to one embodiments. Generally, the controller 190 is operably coupled to or includes a GUI 195. The GUI 195 includes an input mechanism 200 for user-inputs or drilling parameters. The input mechanism 200 may include a touch-screen, keypad, voice-recognition apparatus, dial, button, switch, slide selector, toggle, such as a control mode toggle 202, joystick, mouse, data base and/or other conventional or future-developed data input device. Such input mechanism 200 may support data input from local and/or remote locations. Alternatively, or additionally, the input mechanism 200 may include means for user-selection of input parameters, such as predetermined toolface set point values or ranges, such as via one or more drop-down menus, input windows, etc. Drilling parameters may also or alternatively be selected by the controller 190 via the execution of one or more database look-up procedures. In general, the input mechanism 200 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other means. The GUI 195 may also include a display 205 for visually presenting information to the user in textual, graphic, or video form. The display 205 may also be utilized by the user to input the input parameters in conjunction with the input mechanism 200. For example, the input mechanism 200 may be integral to or otherwise communicably coupled with the display 205. In some embodiments, the display 205 is arranged to present visualizations of a down hole environment, such as a two-dimensional visualization and/or a three-dimensional visualization. Depending on the implementation, the display 205 may include, for example, an LED or LCD display computer monitor, touchscreen display, television display, a projector, or other display device. The GUI 195 and the controller 190 may be discrete components that are interconnected via wired or wireless means. Alternatively, the GUI 195 and the controller 190 may be integral components of a single system or controller. The controller 190 is configured to receive electronic signals via wired or wireless transmission means (not shown) from a plurality of sensors 210 included in the apparatus 100, where each sensor is configured to detect an operational characteristic or parameter. The controller 190 also includes a drilling module 235 to control a drilling operation. In the embodiment shown, the drilling module is or includes a smartslide program configured to control at least a portion of a slide drill segment of the drilling operation.

The drilling module 235 may include a variety of sub modules, with each of the sub modules being associated with a predetermined workflow or recipe that executes a task from beginning to end. In the embodiment shown, the drilling module 235 includes a slide score optimization submodule 240, including a ramping mode 245, and a ROP optimization submodule 250, including a ROP control mode 255 and a WOB control mode 260. Often, the predetermined workflow includes a set of computer-implemented instructions for executing the task from beginning to end, with the task being one that includes a repeatable sequence of steps that take place to implement the task. The drilling module 235 generally implements the task of completing a steering operation, which steers the BHA 170 along the planned drilling path; recommends and executes the addition of another stand to the drill string 155; recommends and executes the process of tripping out the BHA 170; among other operations. Generally, the instructions for executing a task are based on a plurality of rules or constraints 265. Using the data provided from a plurality of inputs 215 or the plurality of sensors 210, the drilling module 235 is configured to calculate a plurality of metrics 270. Using the plurality of metrics 270, and referencing the plurality of constraints 265, the drilling module 235 is configured to generate instructions that address trends in the data and keeps the drilling operation within tolerances and/or windows, and is further configured to adjust one or more drilling parameters 275 controlled by the drilling module 235.

The drilling module 235 may be further configured to generate a control signal, such as via intelligent adaptive control, and provide the control signal to the top drive control system 220, the mud pump control system 225, and/or the draw works control system 230 to adjust and/or maintain the toolface orientation. For example, the drilling module 235 may provide one or more signals to the top drive control system 220 and/or the draw works control system 230 to increase or decrease WOB and/or quill position, such as may be required to accurately "steer" the drilling operation or increase ROP. In some embodiments, the controller 190 is also operably coupled to a top drive control system 220, a mud pump control system 225, and a draw works control system 230, and is configured to send signals to each of the control systems 220, 225, and 230 to control the operation of the top drive 140, the mud pump 181, and the draw works 130. However, in other embodiments, the controller 190 includes each of the control systems 220, 225, and 230 and thus sends signals to each of the top drive 140, the mud pump 181, and the draw works 130.

In some embodiments, the top drive control system 220 includes the top drive 140, the speed sensor 140*b*, the torque sensor 140*a*, and the hook load sensor 140*c*. The top drive control system 220 is not required to include the top drive 140, but instead may include other drive systems, such as a power swivel, a rotary table, a coiled tubing unit, a downhole motor, and/or a conventional rotary rig, among others.

In some embodiments, the mud pump control system 225 includes a mud pump controller and/or other means for controlling the flow rate and/or pressure of the output of the mud pump 181.

In some embodiments, the draw works control system 230 includes the draw works controller and/or other means for controlling the feed-out and/or feed-in of the drilling line 125. Such control may include rotational control of the draw works (in v. out) to control the height or position of the hook 135 and may also include control of the rate the hook 135 ascends or descends.

The plurality of sensors 210 may include the ROP sensor 130*a*; the torque sensor 140*a*; the quill speed sensor 140*b*; the hook load sensor 140*c*; the surface casing annular pressure sensor 187; the downhole annular pressure sensor 170*a*; the shock/vibration sensor 170*b*; the toolface sensor 170*c*; the MWD WOB sensor 170*d*; the mud motor delta pressure sensor; the bit torque sensor 172*b*; the hook position sensor; a rotary RPM sensor; a quill position sensor; a pump pressure sensor; a MSE sensor; a bit depth sensor; and any variation thereof. The data detected by any of the sensors in the plurality of sensors 210 may be sent via electronic signal to the controller 190 via wired or wireless transmission. The functions of the sensors 130*a*, 140*a*, 140*b*, 140*c*, 187, 170*a*, 170*b*, 170*c*, 170*d*, 172*a*, and 172*b* are discussed above and will not be repeated here.

In some embodiments the top drive control system 220 includes the torque sensor 140*a*, the quill position sensor, the hook load sensor 140*c*, the pump pressure sensor, the MSE sensor, and the rotary RPM sensor, and a controller and/or other means for controlling the rotational position, speed and direction of the quill or other drill string component coupled to the drive system (such as the quill 145 shown in FIG. 1). The top drive control system 220 is configured to receive a top drive control signal from the drilling module 235, if not also from other components of the apparatus 100. The top drive control signal directs the position (e.g., azimuth), spin direction, spin rate, and/or oscillation of the quill 145.

In some embodiments, the draw works control system 230 comprises the hook position sensor, the ROP sensor 130*a*, and the draw works controller and/or other means for controlling the length of drilling line 125 to be fed-out and/or fed-in and the speed at which the drilling line 125 is to be fed-out and/or fed-in.

In some embodiments, the mud pump control system 225 comprises the pump pressure sensor and the motor delta pressure sensor 172*a*.

Figure 3:
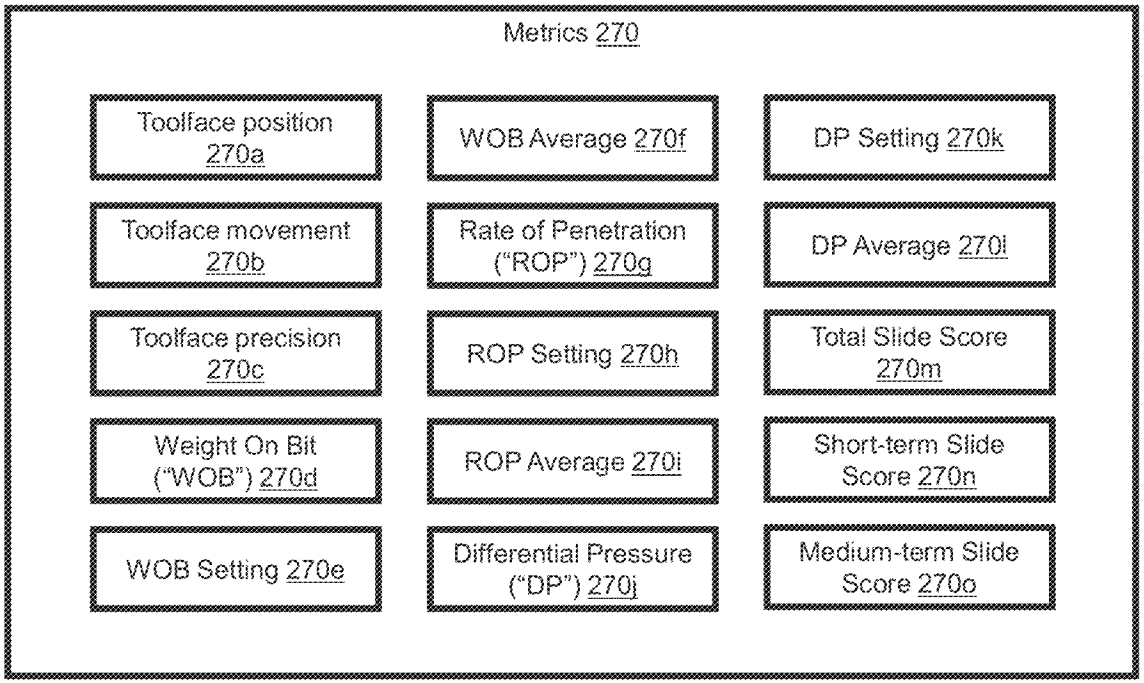
FIG. 3 illustrates a plurality of metrics associated with the automated directional drilling control system of FIG. 2, according to one or more embodiments of the present disclosure.

FIG. 3 illustrates the plurality of metrics 270, according to one or more embodiments. In one or more embodiments, as discussed above, the plurality of metrics 270 may be generated or referenced by the drilling module 235. In one or more embodiments, the plurality of metrics 270 include: (a) a toolface position 270*a*, which indicates which direction the high side of the motor is facing with respect to magnetics or gravity MWD readings; (b) a toolface movement 270*b*, which is the distance in degrees between consecutive toolface values, where positive values indicate clockwise movement and negative values indicate counter-clockwise movement; (c) a toolface precision 270*c*, which is the running average of the absolute values of each of the last five toolface distances from the average toolface, measured in degrees; (d) a WOB 270*d*, which is the raw value or actual value of the WOB; (e) a WOB setting 270*e*, which is a setpoint for the WOB in the drilling module 235 that limits the amount of WOB used for drilling; (f) a WOB average 270*f*, which is the running average WOB calculated over a period of time, such as, for example, the previous one minute period of drilling; (g) a ROP 270*g*, which is the raw value or actual value of the ROP; (h) a ROP setting 270*h*, which is a setpoint for the ROP in the drilling module 235 that limits the amount of ROP used for drilling; (i) a ROP average, which is the running average ROP calculated using the change in position of the traveling block 120 over a period of time, such as, for example, the previous one minute period of drilling; (j) a differential pressure 270*j*, which is the raw value or actual value of the differential pressure, and which, in one or more embodiments, refers to the difference in pressure between the pressure exerted by the drilling fluid in the wellbore and the pressure of the formation at a given depth; (k) a differential pressure setting 270*k*, which is the setpoint for the differential pressure in the drilling module 235 that limits the amount of differential pressure used for drilling; (l) a differential pressure average 270*l*, which is the running average differential pressure calculated over a period of time, such as, for example, the previous one minute period of drilling; (m) a total slide score 270*m*, which is a current slide score calculation that covers the entirety of the slide, grading the accuracy of the toolfaces relative to a target toolface, as a percentage from −100% to 100%; (n) a short-term slide score 270*n*, which is a running slide score for a period of time, such as, for example, a previous two minute period of the slide; and (o) a medium-term slide score 2700, which is a running slide score for a period of time that is longer than the period of time associated with the short-term slide score 270*n*, such as, for example, a previous five minute period of drilling.

In one or more embodiments, the metrics 270 may also include, for example, a toolface distribution to target (e.g., percentage of toolface values within X degrees of the advisory toolface angle), resultant slide vector (e.g., the aggregate toolface direction of all toolface measurements throughout a single slide), current slide distance, remaining slide distance, bit proximity to steering line or steering window, qualitative information that describes the adherence of the as-drilled trajectory to the planned trajectory or input steering line, real-time information about the actual current inclination and azimuth of the BHA, as measured at the each stationary survey, and real-time information about the projected current inclination and azimuth of the bit, as well as other types of sensor data and feedback from various drilling systems.

Figure 4:
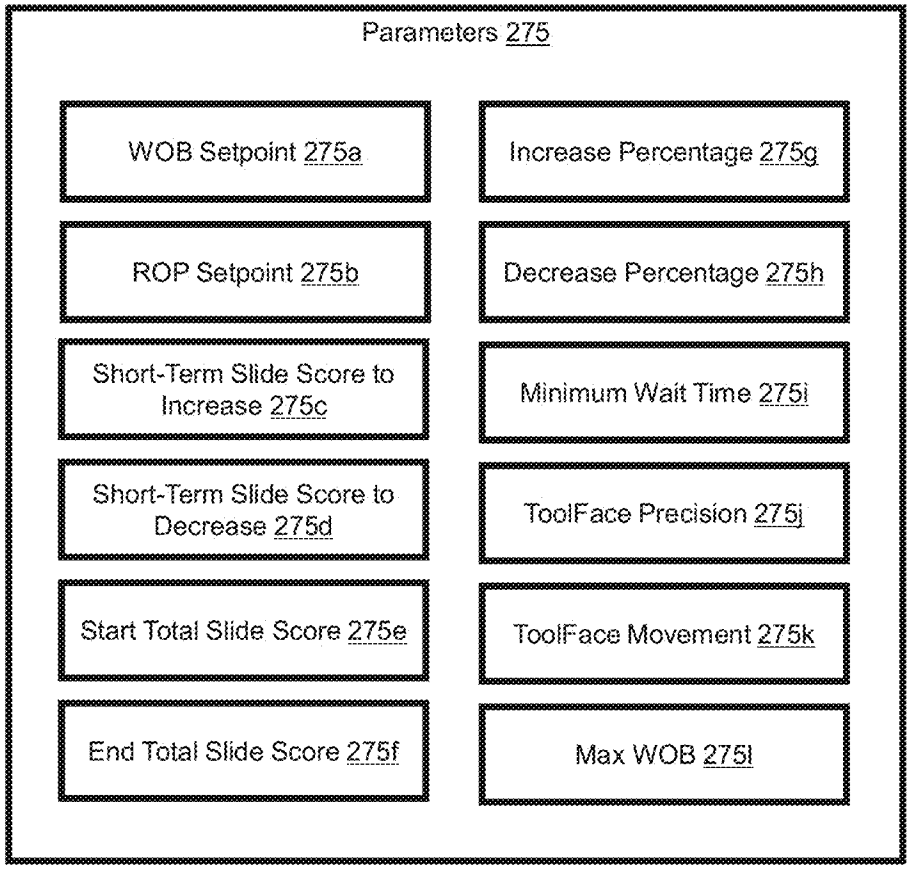
FIG. 4 illustrates a plurality of parameters associated with the automated directional drilling control system of FIG. 2, according to one or more embodiments of the present disclosure.

FIG. 4 illustrates the plurality of drilling parameters 275 that may be adjusted by the drilling module 235 before or during a drilling operation. In one or more embodiments, each of the plurality of parameters is initially set via the plurality of inputs 215 received from a user via the GUI 195 or received automatically from a databased, recipe, well plan, etc. In one or more embodiments, the plurality of drilling parameters 275 includes: (a) a WOB setpoint 275*a*; and (b) a ROP setpoint 275*b*. In one or more embodiments, the WOB setpoint 275*a* and the ROP setpoint 275*b* may be the only drilling parameters used by the drilling module 235 to control the drilling operation. In one or more embodiments, either the WOB setpoint 275*a* or the ROP setpoint 275*b* is controlling and the other is floating. As used herein, "floating" refers to setting the non-controlling parameter setpoint to a value that is a predetermined percentage above the current running average value metric of that parameter. For example, when the drilling module 235 is operating in the ROP control mode 255 of the ROP optimization submodule 250, the ROP setpoint 275*b* is the controlling parameter that is continuously adjusted while the WOB setpoint 275*a* is the floating parameter that is maintained at a predetermined percentage above the WOB average 270*f*. For further example, when the drilling module 235 is operating in the WOB control mode 260 of the ROP optimization submodule 250, the WOB setpoint 275*a* is the controlling parameter that is continuously adjusted while the ROP setpoint 275*b* is the floating parameter that is maintained at a predetermined percentage above the ROP average 270*i*.

In one or more embodiments, the plurality of drilling parameters 275 further includes: (c) a short-term slide score to increase 275*c*, which is a minimum short-term slide score and the average of the short-term slide score 270*n* and the medium-term slide score 2700 to trigger an increase in the controlling parameter; (d) a short-term slide score to decrease 275*d*, which is the maximum short-term slide score and the average of the short-term slide score 270*n* and the medium-term slide score 2700 to trigger a decrease in the controlling parameter; (e) a start total slide score 275*e*, which is the minimum total slide score 270*m* at a start of a slide to trigger an increase of the controlling parameter and the maximum value to trigger a decrease of the controlling parameter; (f) an end total slide score 275*f*, which is the minimum total slide score 270*m* at an end of a slide to trigger an increase of the controlling parameter and the maximum value to trigger a decrease of the controlling parameter, where a total slide score constraint is a moving value that changes linearly over the course of a slide if the start and end total slide scores are different; (g) an increase percentage 275*g*, which is a user- or recipe-defined percentage increase of ROP or WOB, depending on which control mode is being used, to be used anytime adjustment of the controlling parameter is triggered by the logic of the controller 190; (h) a decrease percentage 275*h*, which is a user- or recipe-defined percentage decrease of ROP or WOB, depending on which control mode is being used, to be used anytime a decrease of the controlling parameter is triggered by the logic of the controller 190; (i) a minimum wait time 275*i*, which is an amount of time that the drilling module 235 must wait before reevaluating whether the controlling parameter can be increased or decreased, such that a timer associated with the minimum wait time 275*i* resets after each adjustment of the controlling parameter, and, in one or more embodiments, the minimum wait time 275*i* has a default of 30 seconds plus at least one toolface position 270*a* must be received during this time, otherwise the drilling module 235 will wait up to an additional 30 seconds to receive a new toolface position 270*a*; (j) a toolface precision 275*j*, which is constantly calculated and must be less than 100 to increase parameters; (k) a toolface movement 275*k*, which is constantly calculated and must be less than 100 to increase parameters; and (l) a max WOB 275*l*, which is the maximum WOB setpoint that the drilling module 235 will write to the controller 190.

In one or more embodiments, the initial setpoints for the plurality of parameters 275 may be received via user input or may be accessed from a recipe or database. In one or more embodiments, the initial setpoint of the percentage associated with the WOB setpoint 275*a* may be in the range from 0-percent to 150-percent, such that the WOB setpoint 275*a* 0-percent to 150-percent greater than an average WOB. In one or more embodiments, the initial setpoint of the percentage associated with the ROP setpoint 275*b* may be in the range from 0-percent to 150-percent, such that the ROP setpoint 275*b* 0-percent to 150-percent greater than an average ROP. In one or more embodiments, the initial setpoint of the short-term slide score to increase 275*c* may be in the range of −100 to 100. In one or more embodiments, the initial setpoint of the short-term slide score to decrease 275*d* may be in the range of 0 to 100. In one or more embodiments, the initial setpoint of the start total slide score 275*e* may be in the range of −50 to 100. In one or more embodiments, the initial setpoint of the end total slide score 275*f* may be in the range of 0 to 100. In one or more embodiments, the initial setpoint for the increase percentage 275*g* may be in the range of 1-percent to 20-percent. In one or more embodiments, the initial setpoint for the decrease percentage 275*h* may be in the range of 1-percent to 20-percent. In one or more embodiments, the initial setpoint for the minimum wait time 275*i* may be 30-seconds, 50-seconds, 70-seconds, 90-seconds, 120-seconds, or between 30- and 120-seconds. In one or more embodiments, the initial setpoint of the max WOB 275*l* may be in the range of 5 klb to 95 klb. In one or more embodiments, the initial setpoint, or proactive offset, for the toolface precision 275*i* and/or the toolface movement 275*k* may be from 0-degrees to 90-degrees.

In one or more other embodiments, the plurality of parameters, which may be received via the input mechanism 200 and/or from a database, may include a well plan input, a maximum WOB input, a top drive input, a draw works input, a mud pump input, best practices input, operating parameters, and equipment identification input, etc. In some embodiments, the plurality of operating parameters may include a maximum slide distance; a maximum dogleg severity; and a minimum radius of curvature. The plurality of operating parameters also includes orientation-tolerance window ("OTW") parameters, such as an inclination tolerance range and an azimuth tolerance range. The plurality of operating parameters also includes parameters that define an unwanted downhole trend, such as an equipment output trend parameters, geology trend parameters, and other downhole trend parameters. The plurality of operating parameters also includes location-tolerance window ("LTW") parameters, such as an offset direction, an offset distance, geometry, size, and dip angle. In some embodiments, the maximum slide distance may be zero. That is, no slides are recommended while the BHA 170 extends within a first formation type or during a specific period of time relative to the drilling process. The maximum slide distance is not limited to zero feet, but may be any number of feet or distance, such as for example 10 ft., 20 ft., 30 ft., 40, ft. 50 ft., 90 ft., etc. Generally, the maximum dogleg severity is the change in inclination over a distance and measures a build rate on a micro-level (e.g., 3°/100 ft.) while the minimum radius of curvature is associated with a build rate on a macro-level (e.g., 1°/1,000 ft.).

The orientation-tolerance window parameters include an inclination tolerance range and an azimuth tolerance range. In some embodiments, the inclination tolerance range and the azimuth tolerance range are associated with a location along the well plan and change depending upon the location along the well plan. That is, at some points along the well plan the inclination tolerance range and the azimuth tolerance range may be greater than the inclination tolerance range and the azimuth tolerance range along other points along the well plan.

Figure 5A:
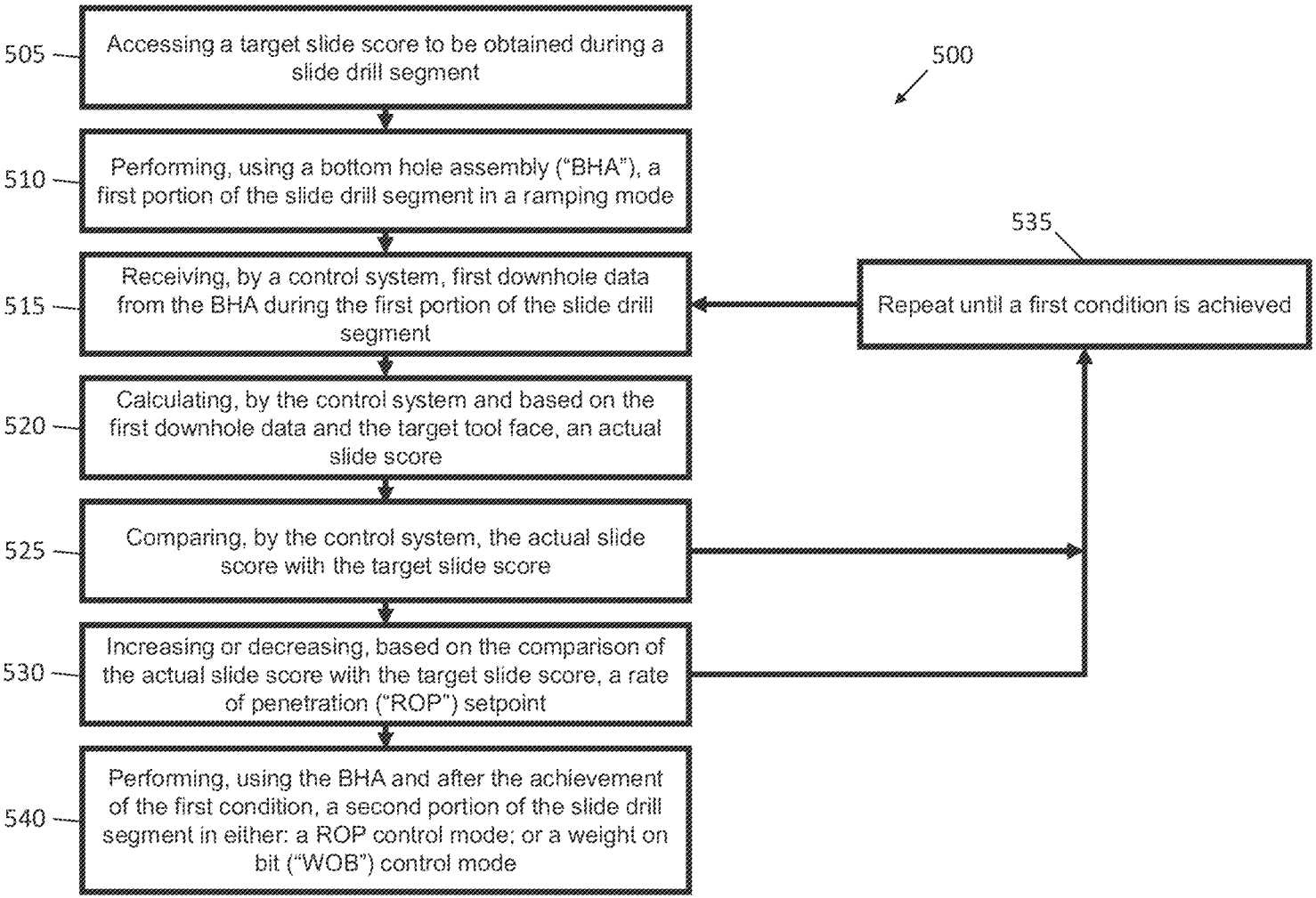
FIG. 5A illustrates a first portion of a method for operating the automated directional drilling control system of FIG. 2, the first portion of the method including a ramping mode, according to one or more embodiments of the present disclosure.
Figure 5B:
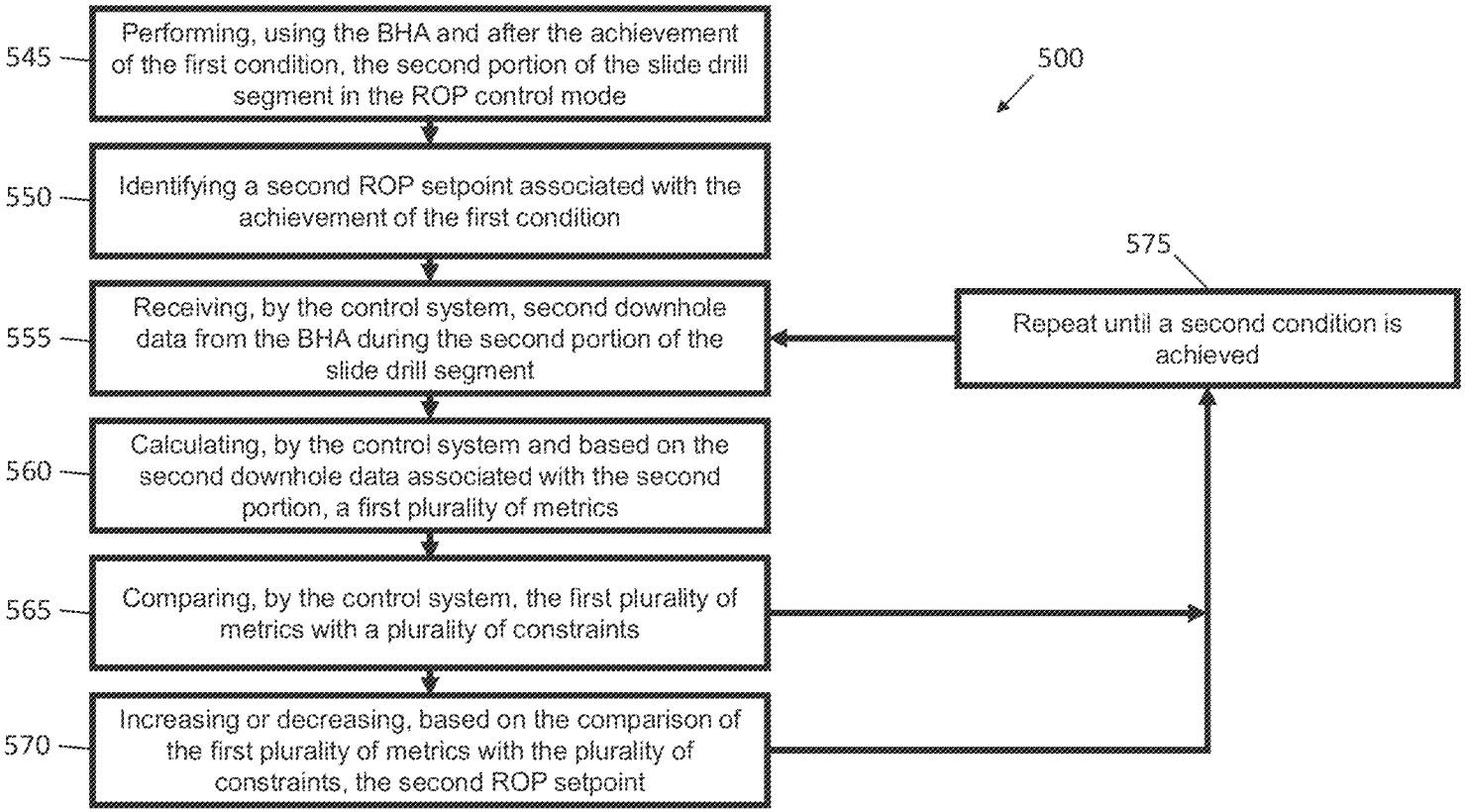
FIG. 5B illustrates a second portion of the method for operating the automated directional drilling control system of FIG. 2, the second portion of the method including a ROP control mode, according to one or more embodiments.
Figure 5C:
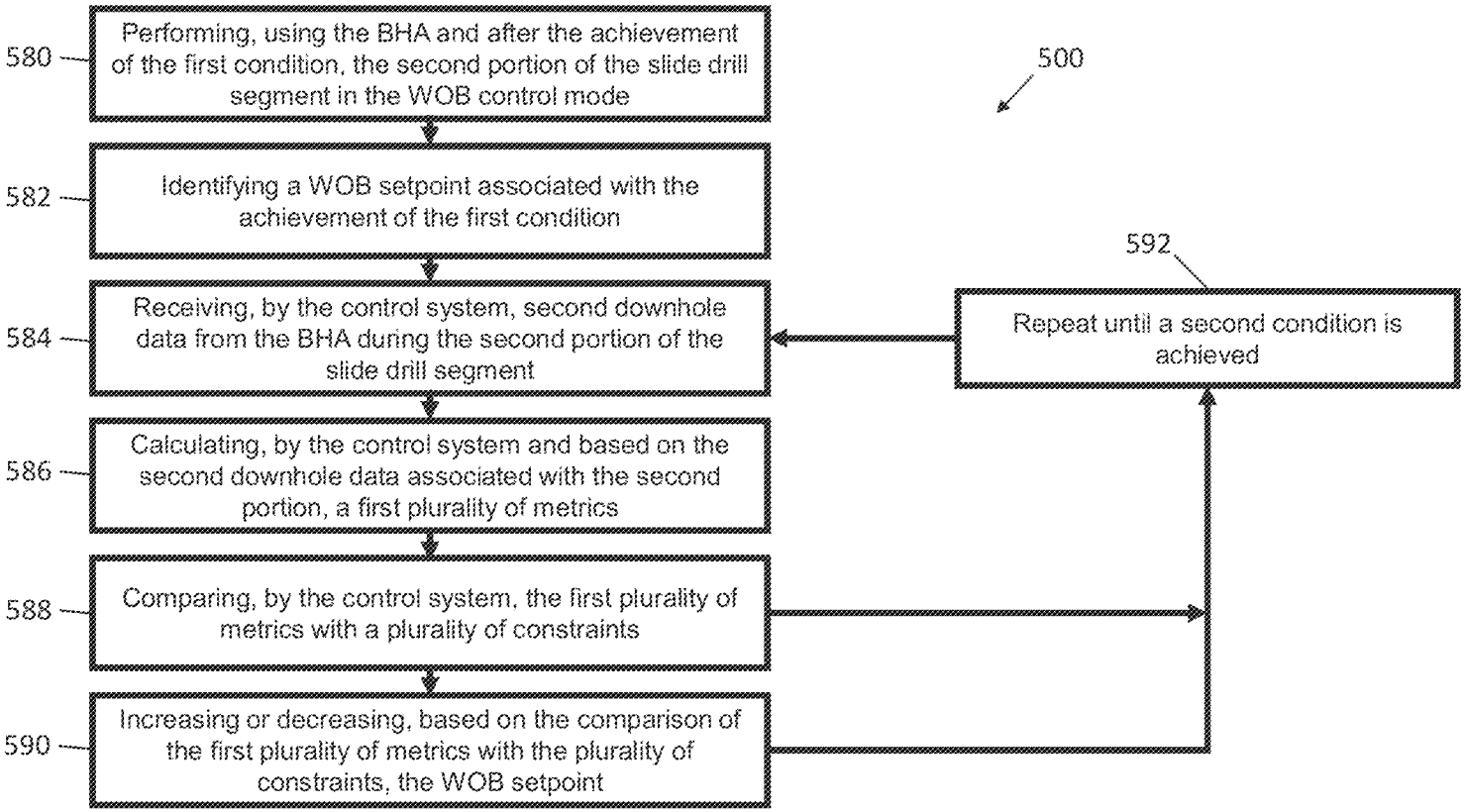
FIG. 5C illustrates a third portion of the method for operating the automated directional drilling control system of FIG. 2, the third portion of the method including a WOB control mode.

FIG. 5A-5C, with continued reference to FIGS. 1-4, illustrates a method 500 of operating the automated directional drilling control system 192, according to one or more embodiments.

In general, the automated directional drilling control system 192 of the present disclosure automatically adjusts drilling parameter setpoints (e.g., the setpoints of each of the plurality of parameters 275) to optimize performance. Based on slide drilling performance goals, a set of constraints (e.g., the plurality of constraints 265) is configured in a programmable logic computer ("PLC") associated with the controller 190 to optimize ROP and/or tool face control (or "slide scores") during slide drilling operations by automatically manipulating the drilling parameter setpoint when running an automated directional drilling control system. In one or more embodiments, the automated directional drilling control system 192 continually increases ROP and/or other drilling parameters if the constraints 265 are met. Automating the control of the drilling parameters standardizes the adjustment and control of the drill, which improves the consistency and efficiency of the drilling operation and reduces the incidence of human error. In one or more embodiments, the automated directional drilling control system monitors a plurality of conditions of the drilling operation. In one or more embodiments, a plurality of sensors (e.g., plurality of sensors 210) associated with the apparatus 100 transmit data associated with these conditions to the automated directional drilling control system 192 and to the controller 190. Using the logic with which the PLC of the controller 190 is programmed, and based on the data received from the plurality of sensors 210, the automated directional drilling control system 192 continuously calculates a plurality of metrics (e.g., the plurality of metrics 270) to be evaluated against the constraints 265. In one or more embodiments, the metrics 270 may be calculated and evaluated in real-time, or near real-time. In or more embodiments, calculating the metrics 270 may include calculating running averages using real-time and historical data. Based on the evaluation of the metrics 270 against the constraints 265, the controller 190 may increase, decrease, or maintain one or more of the drilling parameters 275.

Now, with specific reference to FIG. 5A, a first portion of method 500 for operating the automated directional drilling control system 192 is shown and described according to one or more embodiments of the present disclosure. In one or more embodiments, method 500 is executed using the drilling module 235 stored on the controller 190.

At step 505, a target slide score (or "slide score goal") to be obtained during a slide drill segment of a drilling operation is accessed. In one or more embodiments, the target slide score may be received by the controller 190 via a user input manually entered via the input mechanism 200 of the GUI 295. In one or more embodiments, the target slide score may be accessed from a recipe stored in a database that may be positioned locally or remotely relative to the controller 190. In one or more embodiments, the target slide score may include a range of acceptable slide scores. In one or more embodiments, the target slide score is associated with a target toolface of the BHA while performing the slide drill segment. In one or more embodiments, the target toolface is received via a user input using the input mechanism 200 of the GUI 295. In one or more embodiments, the target toolface is accessed from a recipe stored in a database. In one or more embodiments, a target slide score is accessed at the beginning of each slide segment of a drilling operation. In one or more embodiments, the target slide score is accessed at the beginning of a first slide drill segment and may remain the same throughout two or more slide drill segments.

At step 510, a first portion of the slide drill segment is performed, using the BHA 170, in the ramping mode 245 of the slide score optimization submodule 240 of the drilling module 235. In the ramping mode 245, the drilling module 235 will continue to increase ROP as long as the target slide score is being achieved. This enables the system to maximize ROP without sacrificing accuracy of the direction of the slide.

At step 515, during performance of the first portion of the slide drill segment in ramping mode 245, downhole data is received from the plurality of sensors 210 associated with the apparatus 100, including the BHA 170. In one or more embodiments, the downhole data may include data associated with one or more of the plurality of parameters 275. In one or more embodiments, the downhole data may include data associated with toolface precision 275*j* and toolface movement 275*k*. In one or more embodiments, the downhole data is received by the controller 190.

At step 520, the downhole data and the target slide score are used by the controller 190 and/or the drilling module 235 to calculate an actual slide score associated with the first portion of the slide drill segment. In one or more embodiments, the actual slide score is calculated by receiving a set number of consecutive toolface readings from the plurality of sensors 210 during a period and comparing the received toolface readings with the target toolface.

At step 525, the actual slide score calculated in step 520 is compared with the target slide score to determine whether the first portion of the slide drill segment is being performed as desired and is following the desired trajectory, path, or direction. In one or more embodiments, where the target slide score includes a range of acceptable slide scores, the comparison performed at step 525 includes a determination of whether the actual slide score is inside or outside the range of acceptable slide scores. In one or more embodiments, if the comparison at step 525 does not indicate or trigger an adjustment of the automated directional drilling control system 192, then the method 500 proceeds to step 535, which includes repeating steps 515 through 530 until a first condition is achieved. In one or more embodiments, if the comparison at step 525 does indicate or triggers an adjustment of the automated directional drilling control system 192, then the method 500 proceeds to step 530.

At step 530, a ROP or ROP setpoint associated with the first portion of the slide drill segment is increased or decreased based on the comparison of the actual slide score with the target slide score. As generally stated above, as long as the target slide score is being achieved, the controller 190 will maximize ROP. In one or more embodiments, if the actual slide score is within a predetermined threshold associated with the target slide score, the ROP setpoint will be increased, and if the actual slide score is outside the predetermined threshold, the ROP setpoint will be decreased, or in some embodiments, remain unchanged. In one or more embodiments, where the target slide score includes a range of acceptable slide scores, if the actual slide score is within the range of acceptable slide score, the ROP setpoint will be increased, and if the actual slide score is outside the range of acceptable slide scores, the ROP setpoint will be decreased, or in some embodiments, remain unchanged. In one or more embodiments, the controller 190 implements the increase or decrease of the ROP setpoint. In one or more embodiments, adjusting the ROP setpoint is associated with, or triggers, adjustment of one or more of the plurality of parameters 275. In one or more embodiments, adjusting the ROP setpoint includes or is associated with control signals being sent from the controller 190 to one or more of the top drive control system 220, the mud pump control system 225, and the draw works control system 230. In one or more embodiments, after increasing or decreasing the ROP setpoint at step 530, the method 500 continues to step 535, which includes repeating steps 515 through 530 until a first condition is achieved.

At step 540, a second portion of the slide drill segment is performed, using the BHA and after the first condition has been achieved, in either the ROP control mode 255 or the WOB control mode 260 of the ROP optimization submodule 250 of the drilling module 235.

In one or more embodiments, the first condition includes the actual toolface or the actual slide score being equal to the target toolface or the target slide score, respectively. In one or more embodiments, the first condition includes receiving a selection associated with activating the ROP optimization submodule 250. In one or more embodiments, the first condition includes receiving a selection associated with activating either the ROP control mode 255 or the WOB control mode 260. In one or more embodiments, the first condition includes one or more conditions associated with the automated directional drilling control system 192 being achieved, which allows the ROP optimization submodule 250 to become active. In one or more embodiments, the one or more conditions that allow the ROP optimization submodule 250 to become active include: (a) a ROP optimization feature associated with the ROP optimization submodule 250 is ENABLED; (b) the apparatus 100, the controller 190, and the drilling module 235 are running and operational; (c) a pilot is ON and in a maintain mode, which is an automatic running mode and which is associated with a current slide sequence; (d) the bit is on bottom relative to the hole, where "on bottom" means, for example, the hole depth minus 0.5 ft, such that, for example, the bit depth is greater than or equal to the hole depth minus 0.5 ft; (e) a minimum number of toolfaces have been received, which may be a predetermined number of toolfaces; and (f) at least 1-minute of downhole data associated with the plurality of metrics 270, including ROP 270*g*, WOB 270*d*, and differential pressure 270*j* data, have been received such that running averages, including WOB average 270*f*, ROP average 270*i*, and differential pressure average 270*l* can be calculated and utilized in the ROP optimization submodule 250. Ensuring one or more of these conditions associated with the ROP optimization submodule 250 becoming active is achieved facilitates appropriate selections of initial setpoints of the plurality of parameters 275 and ensures that the differential pressure has stabilized after reaching (or "tagging") the bottom of the hole. In one or more embodiments, the ROP optimization submodule 250 may become active before or during each slide segment, or each portion of each slide segment.

Generally, before the ROP optimization submodule 250 becomes active, a recipe or user-defined parameter setpoints will be used. When the ROP optimization submodule 250 becomes active, the controller 190 sets the initial setpoint of the controlling parameter (e.g., ROP setpoint 275*b* or WOB setpoint 275*a*) to its current average (e.g., ROP average 270*i* or WOB average 270*f*) and begins "floating" the other parameter setpoint above its current average by a user-defined percentage. In one or more embodiments, a control mode toggle (e.g., control mode toggle 202) is used when the ROP optimization submodule 250 is active to facilitate toggling or switching between the ROP control mode 255 and the WOB control mode 260 to effectively select which parameter is controlling and which parameter is floating throughout each slide segment, or each portion of each slide segment. If, in one or more embodiments, neither the ROP setpoint 275*b* or the WOB setpoint 275*a* is selected as the controlling parameter using, for example, the control mode toggle 202, when the ROP optimization submodule 250 becomes active and enabled, then the parameter with a current actual value closest to its setpoint is automatically selected as the controlling parameter until a new controlling parameter is selected using the control mode toggle 202.

In one or more embodiments, the setpoints of the floating parameters are blocked or prevented from being changed manually by a user or operator. In one or more embodiments, there are two sets of constraints 265 used to determine whether the controlling parameter should be increased to drill faster or decreased to drill slower during performance of the slide. In one or more embodiments, the sets of constraints incorporate one or more of the plurality of parameters 275 to constrain the controlling parameter and the operation of the automated directional drilling control system 192. In one or more embodiments, if either set of constraints 265 is met, the controller 190 will adjust the controlling parameter setpoint by a user-defined percentage. After each adjustment, a timer associated with the wait time for recalculating and reevaluating the metrics 270 against the constraints 265 is reset and another adjustment cannot be made until at least the minimum wait time 275*i* has been reached again or expired. The rest of the constraints 265 for either set of constraints must also continue to be met when the minimum wait time 275*i* expires to make another adjustment to the controlling parameter.

FIG. 5B illustrates a second portion of method 500, according to one or more embodiments. In the second portion of method 500, the second portion of the slide drill segment is performed, using the BHA 170 and after the achievement of the first condition, in the ROP control mode 255 of the ROP optimization submodule 250.

At step 545, the second portion of the slide drill segment is performed, using the BHA 170 and after the achievement of the first condition, in the ROP control mode 255. In one or more embodiments, when operating in ROP control mode 255, the ROP setpoint 275*b* is the controlling parameter of the plurality of parameters 275 during the performance of the second portion of the slide drill segment.

At step 550, a second ROP setpoint 275*b* associated with the achievement of the first condition is identified. In one or more embodiments, the second ROP setpoint 275*b*, as the controlling parameter, is initially set to the current ROP average 270*i*, from which value the second ROP setpoint 275*b* is then adjusted during performance of the second portion of the slide drill segment. The other parameters, including the WOB setpoint 275*a*, of the plurality of parameters 275 are floating parameters that are set to values above their respective current average values so that those non-controlling parameters do not interfere with the controlling parameter's ability to control the performance of the second portion of the slide drill segment. In one or more embodiments, when in ROP control mode 255, the WOB setpoint 275*a* is floated at a value that is a predetermined percentage greater than the WOB average 270*f*. In one or more embodiments, the predetermined percentage is a user defined value that is input via the GUI 195, or it is accessed from a recipe stored in a database. In one or more embodiments, the WOB setpoint 275*a* is continuously and automatically updated and rewritten every 10-seconds to account for changes in the value of the WOB average 270*f*. That way, the WOB setpoint 275*a* will continuously float above the current WOB average 270*f*. In one or more embodiments, however, the WOB setpoint 275*a* will not be adjusted to exceed the max WOB 275*l*.

At step 555, during performance of the second portion of the slide drill segment in ROP control mode 255, second downhole data is received from the plurality of sensors 210 associated with the apparatus 100, including the BHA 170. In one or more embodiments, the second downhole data may include data associated with one or more of the plurality of parameters 275. In one or more embodiments, the second downhole data is received by the controller 190.

At step 560, a first plurality of metrics, such as, for example, the plurality of metrics 270, are calculated based on or using the second downhole data associated with the second portion of the slide drill segment. In one or more embodiments, the first plurality of metrics 270 are calculated using the controller 190. In one or more embodiments, the first plurality of metrics 270 are calculated using the drilling module 235.

At step 565, the first plurality of metrics 270 are compared with a plurality of constraints, such as, for example, the plurality of constraints 265. In one or more embodiments, the plurality of constraints 265 include two sets of constraints: (a) a set of constraints for increasing the setpoint of the controlling parameter; and (b) a set of constraints for decreasing the setpoint of the controlling parameter. In one or more embodiments, if none of the plurality of constraints are met by the first plurality of metrics 270, no adjustments are made to the controlling parameter and the method proceeds to step 575, which includes repeating steps 555 through 570. In one or more embodiments, if the plurality of constraints are met by the first plurality of metrics 270, the method proceeds to step 570.

At step 570, the second ROP setpoint 275*b* is increased or decreased based on the comparison of the first plurality of metrics 270 with the plurality of constraints 265. In one or more embodiments, the second ROP setpoint 275*b* is increased if the first plurality of metrics 270 meet or satisfy a set of constraints for increasing the setpoint of the controlling parameter, and the second ROP setpoint 275*b* is decreased if the first plurality of metrics 270 meet or satisfy a set of constraints for increasing the setpoint of the controlling parameter, which sets of constraints will be described in more detail below.

At step 575, steps 555 through 570 are repeated until a second condition is achieved. In one or more embodiments, the second condition includes the control mode toggle 202 being switched from ROP control mode 255 to WOB control mode 260. In one or more embodiments, the second condition includes receiving a selection associated with deactivating the ROP optimization submodule 250. In one or more embodiments, the second condition includes an actual slide score associated with the second portion of the slide drill segment deviating from a target slide score to a value outside acceptable thresholds or outside a range of acceptable slide scores, which, in one or more embodiments, may return the drilling module 235 to the slide score optimization submodule 240.

FIG. 5C illustrates a third portion of method 500, according to one or more embodiments. In the third portion of method 500, the second portion of the slide drill segment is performed, using the BHA 170 and after the achievement of the first condition, in the WOB control mode 260 of the ROP optimization submodule 250. In one or more embodiments, as is described herein, the third portion of the method 500 may occur after the first portion of the method 500 rather than the second portion of the method 500.

At step 580, the second portion of the slide drill segment is performed, using the BHA 170 and after the achievement of the first condition, in the WOB control mode 260. In one or more embodiments, when operating in WOB control mode 260, the WOB setpoint 275*a* is the controlling parameter of the plurality of parameters 275 during the performance of the second portion of the slide drill segment.

At step 582, a WOB setpoint 275*a* associated with the achievement of the first condition is identified. In one or more embodiments, the WOB setpoint 275*a*, as the controlling parameter, is initially set to the current WOB average 270*f*, plus 1 klbs in some embodiments, from which value the WOB setpoint 275*a* is then adjusted during performance of the second portion of the slide drill segment. The other parameters, including the ROP setpoint 275*b*, of the plurality of parameters 275 are floating parameters that are set to values above their respective current average values so that such non-controlling parameters do not interfere with the controlling parameter's ability to control the performance of the second portion of the slide drill segment. In one or more embodiments, when in WOB control mode 260, the ROP setpoint 275*b* is floated at a value that is a predetermined percentage greater than the ROP average 270*i*. In one or more embodiments, the predetermined percentage is a user defined value that is input via the GUI 195, or it is accessed from a recipe stored in a database. In one or more embodiments, the ROP setpoint 275*b* is continuously and automatically updated and rewritten every 10-seconds to account for changes in the value of the ROP average 270*i*. That way, the ROP setpoint 275*b* will continuously float above the current ROP average 270*i*. In one or more embodiments, however, the ROP setpoint 275*b* will not be adjusted below 15 ft/hr. In one or more embodiments, each time the floating value of the ROP setpoint 275*b* is adjusted, the ROP ramps to the new ROP setpoint 275*b* linearly over an 8-second period of time.

At step 584, during performance of the second portion of the slide drill segment in WOB control mode 260, second downhole data is received from the plurality of sensors 210 associated with the apparatus 100, including the BHA 170. In one or more embodiments, the second downhole data may include data associated with one or more of the plurality of parameters 275. In one or more embodiments, the second downhole data is received by the controller 190.

At step 586, a first plurality of metrics, such as, for example, the plurality of metrics 270, are calculated based on or using the second downhole data associated with the second portion of the slide drill segment performed in WOB control mode 260. In one or more embodiments, the first plurality of metrics 270 are calculated using the controller 190. In one or more embodiments, the first plurality of metrics 270 are calculated using the drilling module 235.

At step 588, the first plurality of metrics 270 are compared with a plurality of constraints, such as, for example, the plurality of constraints 265. In one or more embodiments, the plurality of constraints 265 include two sets of constraints: (a) a set of constraints for increasing the setpoint of the controlling parameter; and (b) a set of constraints for decreasing the setpoint of the controlling parameter. In one or more embodiments, if none of the plurality of constraints are met by the first plurality of metrics 270, no adjustments are made to the controlling parameter and the method proceeds to step 592, which includes repeating steps 584 through 590. In one or more embodiments, if the plurality of constraints is met by the first plurality of metrics 270, the method proceeds to step 590.

At step 590, the WOB setpoint 275*a* is increased or decreased based on the comparison of the first plurality of metrics 270 with the plurality of constraints 265. In one or more embodiments, the WOB setpoint 275*a* is increased if the first plurality of metrics 270 meet or satisfy a set of constraints for increasing the setpoint of the controlling parameter, and the WOB setpoint 275*a* is decreased if the first plurality of metrics 270 meet or satisfy a set of constraints for increasing the setpoint of the controlling parameter, which sets of constraints will be described in more detail below.

At step 592, steps 584 through 590 are repeated until a second condition is achieved. In one or more embodiments, the second condition includes the control mode toggle 202 being switched from WOB control mode 260 to ROP control mode 255. In one or more embodiments, the second condition includes receiving a selection associated with deactivating the ROP optimization submodule 250. In one or more embodiments, the second condition includes an actual slide score associated with the second portion of the slide drill segment deviating from a target slide score to a value outside acceptable thresholds or outside a range of acceptable slide scores, which, in one or more embodiments, may return the drilling module 235 to the slide score optimization submodule 240.

In one or more embodiments, method 500 may include performing a first portion of a slide drill segment in ramping mode 245 under slide score optimization submodule 240 and performing a second portion of the slide drill segment in ROP control mode 255 under ROP optimization submodule 250. In one or more embodiments, method 500 may include performing a first portion of a slide drill segment in ramping mode 245 under slide score optimization submodule 240 and performing a second portion of the slide drill segment in WOB control mode 260 under ROP optimization submodule 250. In one or more embodiments, method 500 may include performing a first portion of a slide drill segment in ramping mode 245 under slide score optimization submodule 240, performing a second portion of the slide drill segment in ROP control mode 255 under ROP optimization submodule 250, and performing a third portion of the slide drill segment in WOB control mode 260 under ROP optimization submodule 250. In one or more embodiments, method 500 may include performing a first portion of a slide drill segment in ramping mode 245 under slide score optimization submodule 240, performing a second portion of the slide drill segment in WOB control mode 260 under ROP optimization submodule 250, and performing a third portion of the slide drill segment in ROP control mode 255 under ROP optimization submodule 250.

In one or more embodiments, as discussed above, the plurality of constraints 265 may include a first set of constraints for increasing the controlling parameter and a second set of constraints for decreasing the controlling parameter.

In one or more embodiments, the set of constraints for increasing the controlling parameter include: (a) the minimum wait time 275*i* since the previous increase or decrease, or since the last evaluation of the constraints, has expired, or if a new toolface has not been received, waiting an additional 30-seconds after the expiration of the minimum wait time 275*i*; (b) the short-term slide score 270*n* is greater than the short-term slide score to increase 275*c*; (c) the average of the short- and medium-term slide scores 270*n*, 2700 is greater than the short-term slide score to increase 275*c*; (d) the total slide score 270*m* is greater than the total slide score, which changes from the start total slide score 275*e* to the end total slide score 275*f* over the course of any given slide distance; (e) the average toolface movement 270*b* is less than 100-degrees; (f) the toolface precision is less than 100-degrees; and (g) with respect to the toolface position 270*a*, either: the last toolface movement 270*b* was clockwise and was between left advisory and 90-degrees right of target; the last toolface movement 270*b* was counterclockwise and was within 90-degrees right to the target; the last toolface movement 270*b* was counterclockwise and left of target and the toolface movement 270*b* was less than 20-degrees and was within left advisory boundary to target; or after minimum time to wait 275*i* plus 30-seconds and the last toolface movement 270*b* was between left advisory boundary to 90-degrees right of target. In one or more embodiments, if each of these constraints is satisfied, the controlling parameter, whether it is the ROP setpoint 275*a* or the WOB setpoint 275*b*, is increased.

In one or more embodiments, the set of constraints for decreasing the controlling parameter include: (a) the minimum wait time 275*i* since the previous increase or decrease, or since the last evaluation of the constraints, has expired, or if a new toolface has not been received, waiting an additional 30-seconds after the expiration of the minimum wait time 275*i*; (b) the short-term slide score 270*n* is less than the short-term slide score to decrease 275*d*; (c) the average of the short- and medium-term slide scores 270*n*, 2700 is less than the short-term slide score to decrease 275*d*; (d) the total slide score 270*m* is less than the total slide score, which changes from the start total slide score 275*e* to the end total slide score 275*f* over the course of any given slide distance; and (e) with respect to the toolface position 270*a*, either: the last toolface movement 270*b* was counterclockwise and was between right advisory and 90-degrees left of target; the last toolface movement 270*b* was clockwise and was within 90-degrees left to the target; the last toolface movement 270*b* was clockwise and the toolface movement 270*b* was less than 20-degrees and was within right advisory boundary to target; or after minimum time to wait 275*i* plus 30-seconds and the last toolface movement 270*b* was between right advisory boundary to 90-degrees left of target. In one or more embodiments, if each of these constraints is satisfied, the controlling parameter, whether it is the ROP setpoint 275*a* or the WOB setpoint 275*b*, is decreased.

In one or more embodiments, if an increase is triggered when operating in ROP control mode 255, the ROP setpoint 275*a* is increased by a predetermined percentage. In one or more embodiments, if a decrease is triggered when operating in ROP control mode 255, the ROP setpoint 275*a* is decreased by a predetermined percentage. In one or more embodiments, if an increase is triggered when operating in WOB control mode 260, either: if a valid ROP/WOB ratio has been calculated, the WOB setpoint 275*b* is increased by 1 klbs to 4 klbs based on the ratio; or if a valid ROP/WOB ratio has not been calculated, the WOB setpoint 275*b* is increased by 1 klbs to 4 klbs based on a predetermined percentage. In one or more embodiments, if a decrease is triggered when operating in WOB control mode 260, the WOB setpoint 275*b* is decreased by a predetermined percentage, but in some embodiments, may not be decreased by more than 3 klbs. In one or more embodiments, any of the triggered increases or decreases may be made based on a determined ratio or relationship between any of the plurality of parameters 275.

In one or more embodiments, the ROP/WOB ratio may only be calculated when an adjustment in the controlling parameter is triggered. In one or more embodiments, the ratio may be calculated as the change in the ROP average 270*i* divided by the change in the WOB average 270*f*. In one or more embodiments, the initial values of the ROP average 270*i* and the WOB average 270*f* are obtained when an increase in the controlling parameter is triggered, i.e., all constraints for increase have been met. Then, in one or more embodiments, the values of the subsequent ROP average 270*i* and WOB average 270*f* are obtained when the next adjustment is triggered or after a predetermined amount of time (e.g., default of 2-minutes), whichever is less. Using this ratio facilitates the ability to adjust the WOB setpoint 275*b* to yield a specific percentage change in ROP 270*g*. In one or more embodiments, if the ratio is less than 1, then the ratio should not be used when adjusting the WOB setpoint 275*b*, rather, in such situations, the WOB setpoint 275*b* should be increased by the predetermined percentage. In one or more embodiments, if the ratio is greater than 1 and yields a WOB 270*d* increase of less than 1 klb, the WOB setpoint 275*b* should be increased by 1 klb. In one or more embodiments, if the ratio yields a WOB 270*d* increase of more than 4 klbs, then the WOB setpoint 275*b* should be increased by 4 klbs.

In one or more embodiments, the controller 190 may also apply a corrective quill position adjustment depending on the tool face position 270*a* at the time an increase or decrease of the controlling parameter is triggered to counter the expected relative torque and toolface movement 270*b*. In one or more embodiments, this corrective quill position adjustment is referred to as a proactive offset.

In one or more embodiments, when all of the constraints for triggering an increase in the controlling parameter have been met, the controller 190 will automatically make a quill correction only in the clockwise direction using a proactive offset degrees parameter, which may be one of the plurality of parameters 275. In one or more embodiments, this automatic quill correction is user-defined and may be anywhere from 0 to 90 degrees in magnitude. In one or more embodiments, if the last toolface position 270*a* was between the target toolface and 90 degrees counterclockwise of the target toolface, the entire user-defined proactive quill correction should be applied. However, in one or more embodiments, if the last toolface position 270*a* was between the target toolface and 90 degrees clockwise of the target toolface, only the proactive quill correction minus the error between the target toolface and the current toolface should be applied, and a "Toolface Remaining" tag should be reset to the default value found from a "Correction Frequency" tag on the display 205 of the GUI 195. This prevents toolface corrections from being made at the same time as a proactive quill correction where they could potentially cancel each other out.

In one or more embodiments, when all of the constraints for triggering a decrease in the controlling parameter have been met, the controller 190 will automatically make a quill correction only in the counterclockwise direction using the proactive offset degrees parameter. In one or more embodiments, this automatic quill correction should be user-defined and can be anywhere from 0 to 90 degrees in magnitude. If the last toolface position 270*a* was between the target toolface and 90 degrees clockwise of the target toolface, the entire user-defined proactive quill correction should be applied. However, in one or more embodiments, if the last toolface position 270*a* was between the target toolface and 90 degrees counterclockwise of the target toolface, only the proactive quill correction minus the error between the target toolface and the current toolface should be applied, and the "Toolface Remaining" tag should be reset to the default value found from the "Correction Frequency" tag on the display 205 of the GUI 195. This prevents toolface corrections from being made at the same time as a proactive quill correction where they could potentially cancel each other out.

Figure 6:
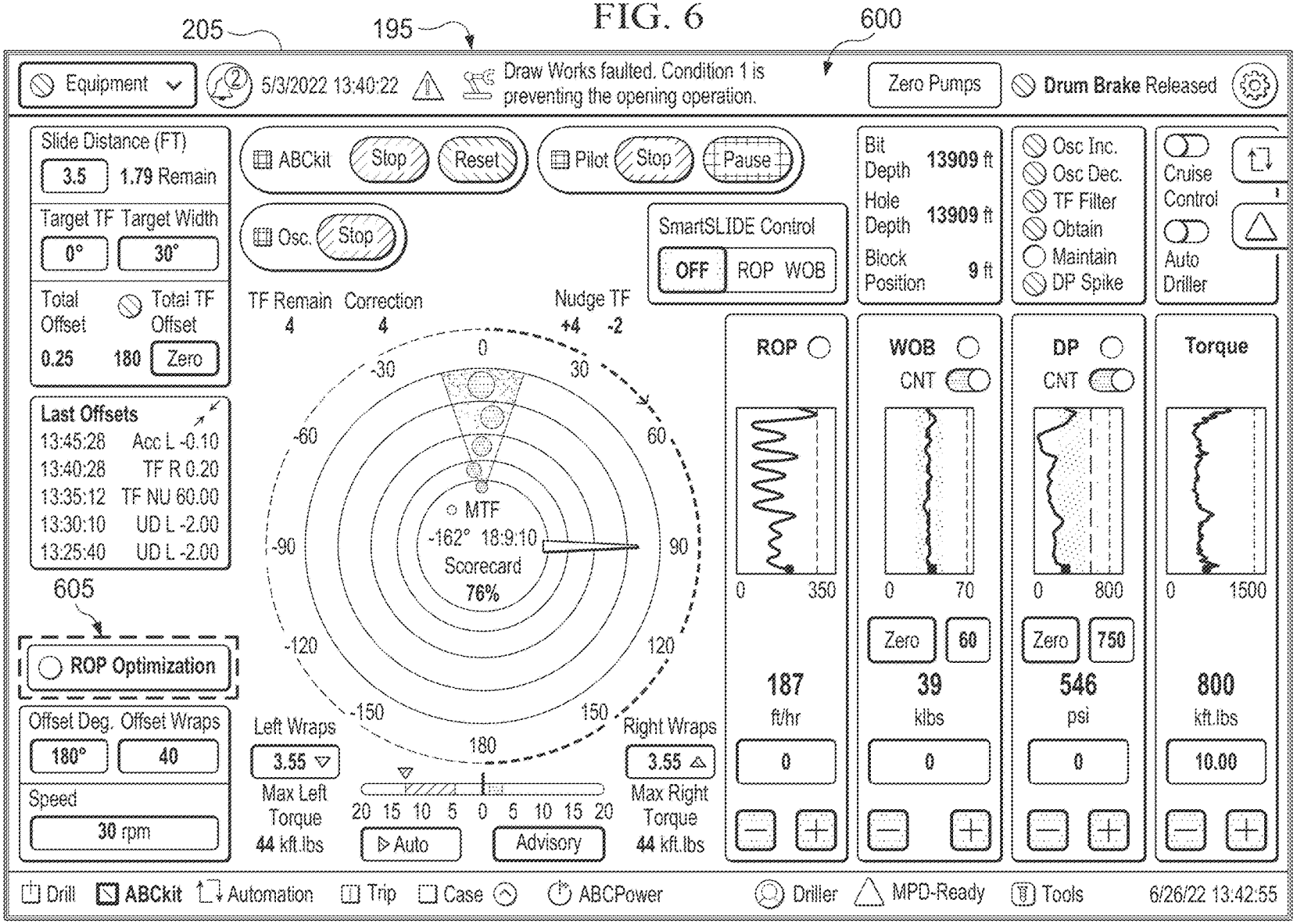
FIG. 6 illustrates a schematic diagram of an example display apparatus showing a two-dimensional visualization, according to one or more embodiments of the present disclosure.

FIG. 6 illustrates a schematic diagram of an example display apparatus, such as display 205 of GUI 195 showing a two-dimensional visualization 600, according to one or more embodiments of the present disclosure. As shown in FIG. 6, the two-dimensional visualization 600 includes an indicator 605 associated with the ROP optimization submodule 250, which, as shown, is grayed-out when the ROP optimization submodule 250 is inactive.

Figure 7:
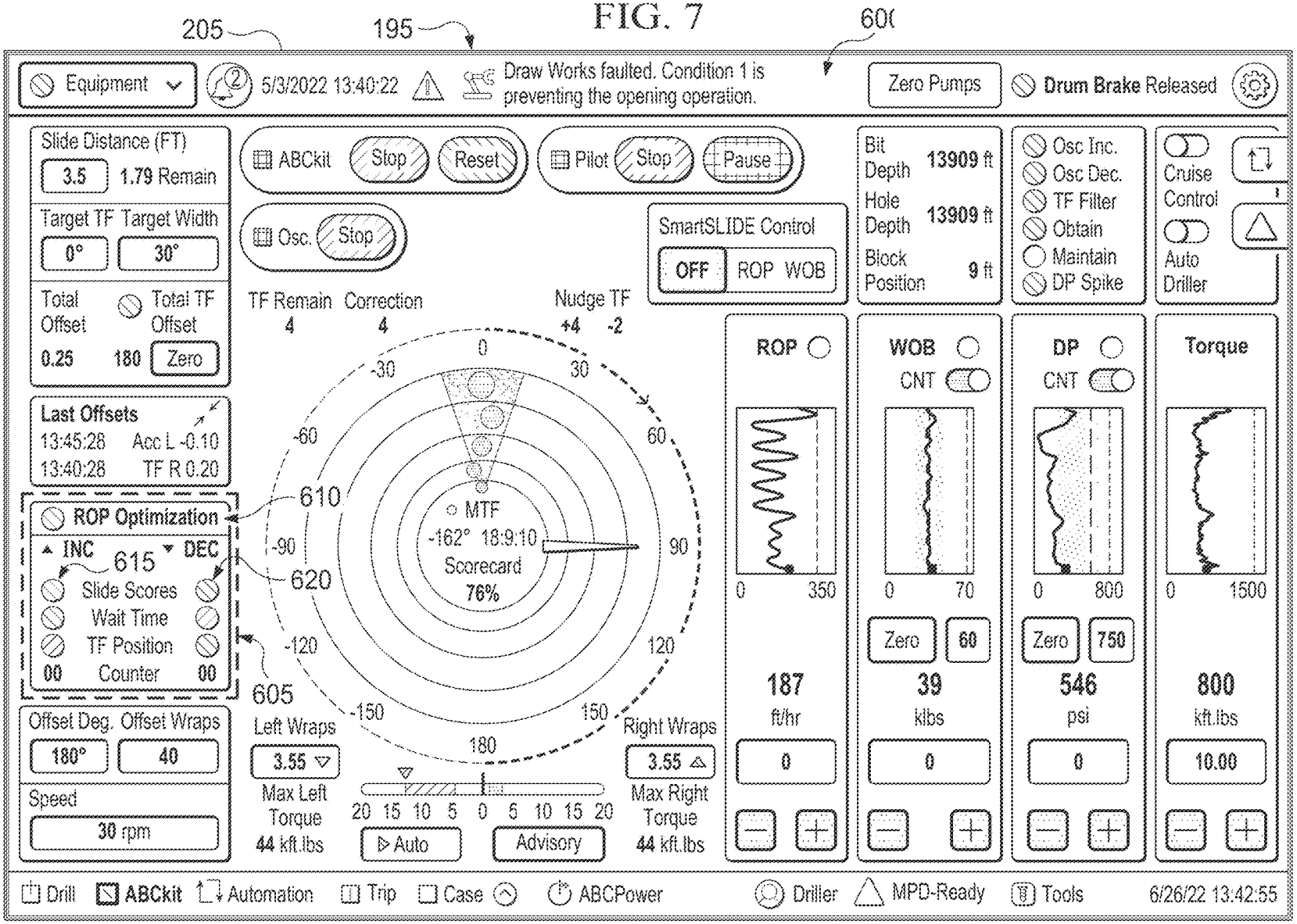
FIG. 7 illustrates the schematic diagram of the example display apparatus of FIG. 6 showing the two-dimensional visualization and a constraint table, according to one or more embodiments of the present disclosure.

FIG. 7 illustrates the two-dimensional visualization 600 including the indicator 605 associated with the ROP optimization submodule 250. In the embodiment shown in FIG. 7, the ROP optimization submodule 250 is active and the indicator 605 associated with the ROP optimization submodule 250 is expanded to show a constraints table 610 including one or more status indicators 615 associated with the set of constraints 265 for increasing the controlling parameter and one or more status indicators 620 associated with the set of constraints for decreasing the controlling parameter.

Figure 8:
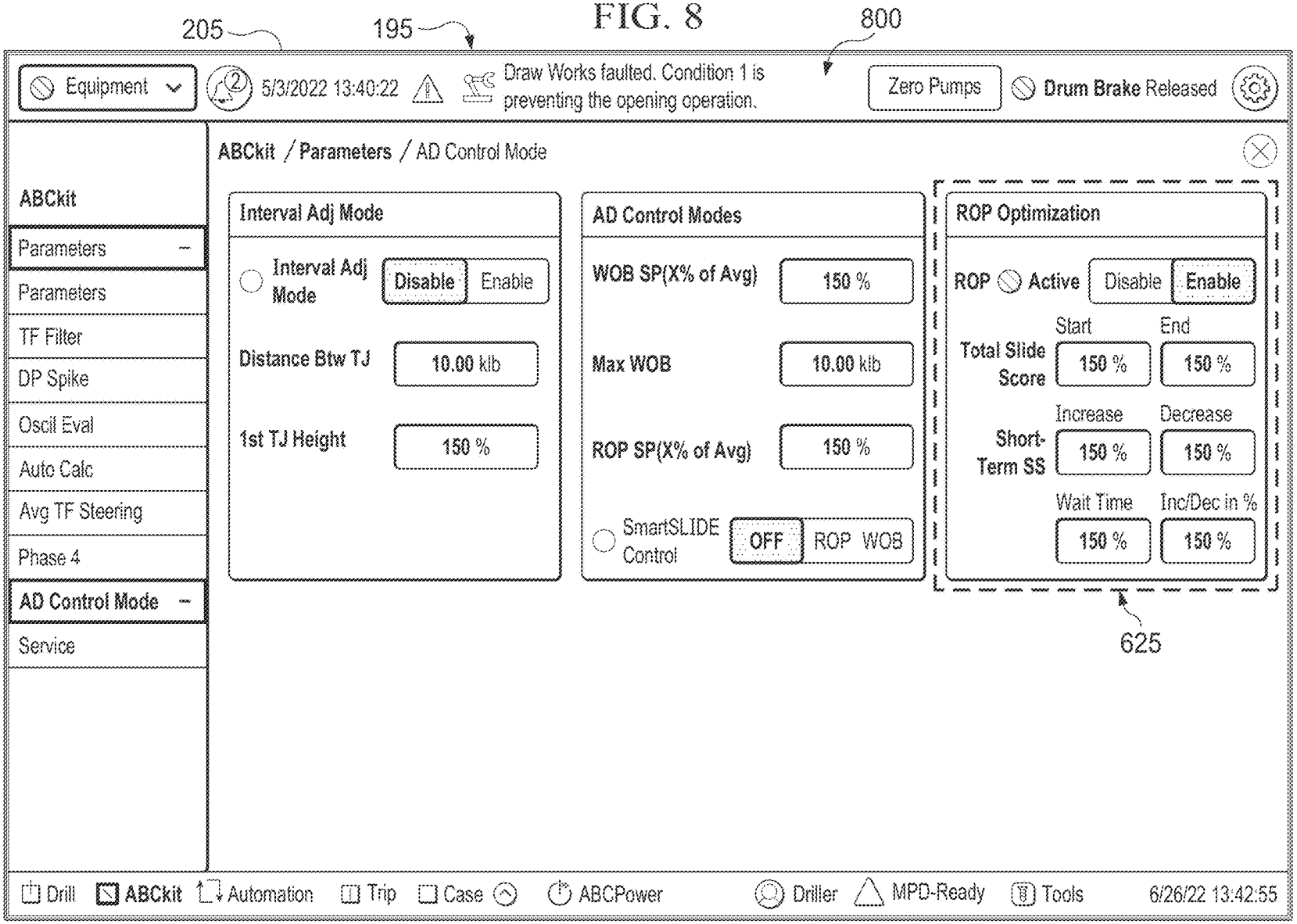
FIG. 8 illustrates the schematic diagram of the example display apparatus of FIG. 6 showing a parameter table associated with the constraint table, according to one or more embodiments of the present disclosure.

FIG. 8 illustrates another two-dimensional visualization 800 including a parameter table 625 associated with the plurality of parameters 275 and associated with the constraint table 610, according to one or more embodiments of the present disclosure.

By adjusting the drilling parameter setpoints throughout the drilling operation automatically using the control system, significantly more efficient rates of penetration and tool face control, which are both indicators of the quality of the slide execution, are realized. The automated control of the drilling parameter setpoints to achieve the performance goals eliminates concerns and issues associated with human operators making individual decisions. The automated control system of the present disclosure will provide operators with a step change in slide drilling rate of penetration, minimize dependency and variability between drillers, reduce training time, promote scaling of the operation, and reduce overall costs.

Figure 9:
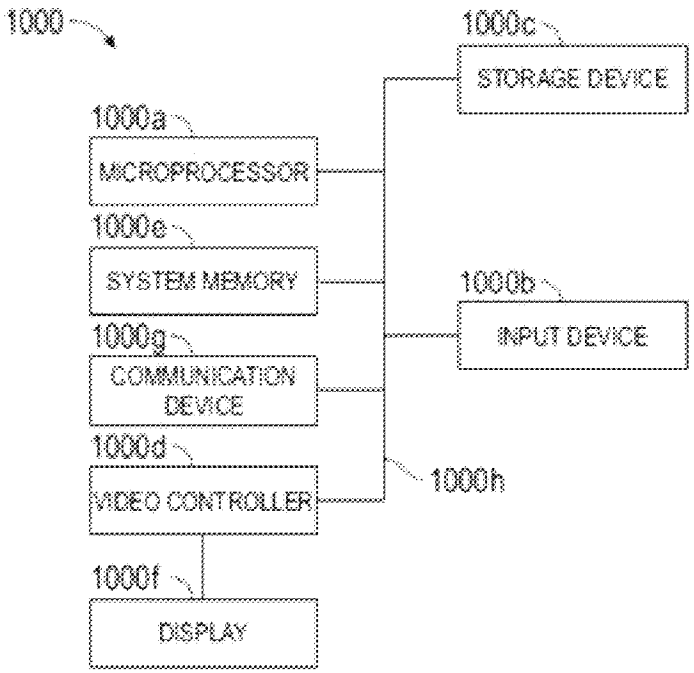
FIG. 9 illustrates a node for implementing one or more example embodiments of the present disclosure, according to one or more embodiments of the present disclosure.

FIG. 9 is a diagrammatic illustration of a node for implementing one or more example embodiments of the present disclosure, according to one or more aspects of the present disclosure.

In an example embodiment, as illustrated in FIG. 9 with continuing reference to FIGS. 1-4, 5A, 5B, 50, and 6-8, an illustrative node 1000 for implementing one or more of the example embodiments described above and/or illustrated in FIGS. 1-4, 5A, 5B, 5C, and 6-8 is depicted. The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In several example embodiments, the storage device 1000*c* may include a floppy drive, hard drive, CD-ROM, optical drive, any other form of storage device and/or any combination thereof. In several example embodiments, the storage device 1000*c* may include, and/or be capable of receiving, a floppy disk, CD-ROM, DVD-ROM, or any other form of computer-readable medium that may contain executable instructions. In several example embodiments, the communication device 1000*g* may include a modem, network card, or any other device to enable the node to communicate with other nodes. In several example embodiments, any node represents a plurality of interconnected (whether by intranet or Internet) computer systems, including without limitation, personal computers, mainframes, PDAs, smartphones and cell phones.

In several example embodiments, one or more of the components of the systems described above and/or illustrated in FIGS. 1-4, 5A, 5B, 50, and 6-8 include at least the node 1000 and/or components thereof, and/or one or more nodes that are substantially similar to the node 1000 and/or components thereof. In several example embodiments, one or more of the above-described components of the node 1000, the apparatus 10, and/or the example embodiments described above and/or illustrated in FIGS. 1-4, 5A, 5B, 5C, and 6-8 include respective pluralities of same components.

In several example embodiments, one or more of the applications, systems, and application programs described above and/or illustrated in FIGS. 1-4, 5A, 5B, 5C, and 6-8 include a computer program that includes a plurality of instructions, data, and/or any combination thereof; an application written in, for example, Arena, HyperText Markup Language (HTML), Cascading Style Sheets (CSS), JavaScript, Extensible Markup Language (XML), asynchronous JavaScript and XML (Ajax), and/or any combination thereof; a web-based application written in, for example, Java or Adobe Flex, which in several example embodiments pulls real-time information from one or more servers, automatically refreshing with latest information at a predetermined time increment; or any combination thereof. The one or more server(s), in some embodiments may be remote (e.g., remote from apparatus 100 and/or the well stimulation apparatus) and accessible by a cloud or other network described herein. In other embodiments, the one or more server(s) are described as one or more edge server(s) and are located on a portion of apparatus 100 and/or the well stimulation apparatus.

In several example embodiments, a computer system typically includes at least hardware capable of executing machine readable instructions, as well as the software for executing acts (typically machine-readable instructions) that produce a desired result. In several example embodiments, a computer system may include hybrids of hardware and software, as well as computer sub-systems.

In several example embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several example embodiments, hardware may include any physical device that is capable of storing machine-readable instructions, such as memory or other data storage devices. In several example embodiments, other forms of hardware include hardware sub-systems, including transfer devices such as modems, modem cards, ports, and port cards, for example.

In several example embodiments, software includes any machine code stored in any memory medium, such as RAM or ROM, and machine code stored on other devices (such as floppy disks, flash memory, or a CD ROM, for example). In several example embodiments, software may include source or object code. In several example embodiments, software encompasses any set of instructions capable of being executed on a node such as, for example, on a client machine or server. In some embodiments, software includes one or more software modules including code, programming object, programming structure, or combinations thereof. In one or more embodiments, the one or more software modules comprise, by way of nonlimiting examples, a web application, a mobile application, and a standalone application. In various embodiments, software modules are in more than one computer program or application. In some embodiments, the software modules are hosted by more than one machine. In some embodiments, the software modules are hosted by more than one machine in more than one location.

In several example embodiments, combinations of software and hardware could also be used for providing enhanced functionality and performance for certain embodiments of the present disclosure. In an example embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several example embodiments, computer readable mediums include, for example, passive data storage, such as a random-access memory (RAM) as well as semi-permanent data storage such as a compact disk read only memory (CD-ROM). One or more example embodiments of the present disclosure may be embodied in the RAM of a computer to transform a standard computer into a new specific computing machine. In several example embodiments, data structures are defined organizations of data that may enable an embodiment of the present disclosure. In an example embodiment, a data structure may provide an organization of data, or an organization of executable code.

In several example embodiments, any networks and/or one or more portions thereof may be designed to work on any specific architecture. In an example embodiment, one or more portions of any networks may be executed on a single computer, local area networks, client-server networks, wide area networks, internets, hand-held and other portable and wireless devices and networks.

In several example embodiments, a database may be any standard or proprietary database software. In several example embodiments, the database may have fields, records, data, and other database elements that may be associated through database specific software. In several example embodiments, data may be mapped. In several example embodiments, mapping is the process of associating one data entry with another data entry. In an example embodiment, the data contained in the location of a character file can be mapped to a field in a second table. In several example embodiments, the physical location of the database is not limiting, and the database may be distributed. In an example embodiment, the database may exist remotely from the server, and run on a separate platform. In an example embodiment, the database may be accessible across the Internet. In several example embodiments, more than one database may be implemented.

In several example embodiments, a plurality of instructions stored on a computer readable medium may be executed by one or more processors to cause the one or more processors to carry out or implement in whole or in part the above-described operation of each of the above-described example embodiments of the system, the method, and/or any combination thereof. In several example embodiments, such a processor may include one or more of the microprocessor 1000*a*, any processor(s) that are part of the components of the system, and/or any combination thereof, and such a computer readable medium may be distributed among one or more components of the system. In several example embodiments, such a processor may execute the plurality of instructions in connection with a virtual computer system. In several example embodiments, such a plurality of instructions may communicate directly with the one or more processors, and/or may interact with one or more operating systems, middleware, firmware, other applications, and/or any combination thereof, to cause the one or more processors to execute the instructions.

In several example embodiments, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several example embodiments, while different steps, processes, and procedures are described as appearing as distinct acts, one or more of the steps, one or more of the processes, and/or one or more of the procedures may also be performed in different orders, simultaneously, and/or sequentially. In several example embodiments, the steps, processes and/or procedures may be merged into one or more steps, processes, and/or procedures.

In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations and this is within the contemplated scope of disclosure herein, unless stated otherwise.

The phrase "at least one of A and B" should be understood to mean "A, B, or both A and B." The phrases "one or more of the following: A, B, and C" and "one or more of A, B, and C" should each be understood to mean "A; B; C; A and B; B and C; A and C; or all three of A, B, and C."

The present disclosure provides a method, including: (a) accessing a target slide score to be obtained during a slide drill segment; wherein the target slide score is associated with a target tool face; (b) performing, using a bottom hole assembly ("BHA"), a first portion of the slide drill segment in a ramping mode; wherein performing, using the BHA, the first portion of control system steerable system, first downhole data from the BHA during the first portion of the slide drill segment; (d) calculating, by the control system and based on the first downhole data and the target tool face, an actual slide score; (e) comparing, by the control system, the actual slide score with the target slide score; (f) increasing or decreasing, based on the comparison of step (e), a rate of penetration ("ROP") setpoint; and (g) repeating steps (c)-(f) until a first condition is achieved; and (h) performing, using the BHA and after the achievement of the first condition, a second portion of the slide drill segment in either: a ROP control mode; or a weight on bit ("WOB") control mode. In one or more embodiments, the first condition includes the actual slide score being equal to the target slide score. In one or more embodiments, the second portion of the slide drill segment is performed in ROP control mode; and wherein performing the second portion of the slide drill segment in ROP control mode includes: (i) identifying a second ROP setpoint associated with the achievement of the first condition; (j) receiving, by the control system, second downhole data from the BHA during the second portion of the slide drill segment; (k) calculating, by the control system and based on the second downhole data associated with the second portion, a first plurality of metrics; (l) comparing, by the control system, the first plurality of metrics with a plurality of constraints; (m) increasing or decreasing, based on the comparison of step (l), the second ROP setpoint; and (n) repeating steps (j)-(m) until a second condition is achieved. In one or more embodiments, the second ROP setpoint is based on a historical ROP from the performance of the first portion of the slide drill segment. In one or more embodiments, the first condition includes receipt, by the control system, of a first selection including a selection of the ROP control mode; and the second condition includes receipt, by the control system, of a second selection including a selection of the WOB control mode. In one or more embodiments, the second portion of the slide drill segment is performed in WOB control mode; and wherein performing the second portion of the slide drill segment in WOB control mode includes: (i) identify a WOB setpoint associated with the achievement of the first condition; (j) receiving, by the control system, second downhole data from the BHA during the second portion of the slide drill segment; (k) calculating, by the control system and based on the second downhole data associated with the second portion, a first plurality of metrics; (l) comparing, by the control system, the first plurality of metrics with the plurality of constraints; (m) increasing or decreasing, based on the comparison of step (l), the WOB setpoint; and (n) repeating steps (j)-(m) until a second condition is achieved. In one or more embodiments, increasing the WOB setpoint includes increasing the WOB setpoint by a predetermined value. In one or more embodiments, the predetermined value is based on a ratio. In one or more embodiments, the ratio is the change in an average ROP over the change in an average WOB. In one or more embodiments, the method further includes (o) performing, using the BHA and after the achievement of the second condition, a third portion of the slide drill segment in ROP control mode; wherein performing the third portion of the slide drill segment in ROP control mode includes: (p) identifying a second ROP setpoint associated with the achievement of the second condition; (q) receiving, by the control system, third downhole data from the BHA during the third portion of the slide drill segment; (r) calculating, by the control system and based on the third downhole data associated with the third portion, a second plurality of metrics; (s) comparing, by the control system, the second plurality of metrics with the plurality of constraints; (t) increasing or decreasing, based on the comparison of step(s), the second ROP setpoint; and (u) repeating steps (q)-(t) until a third condition is achieved. In one or more embodiments, the target slide score includes a range of acceptable slide scores; step (e) further includes determining that the actual slide score is within the range of acceptable slide scores of the target slide score; and step (f) further includes increasing, based on the determination that the actual slide score is within the range of acceptable slide scores of the target slide score, the ROP setpoint. In one or more embodiments, step (h) includes: assigning, when in ROP control mode, a value to a WOB setpoint that is a predetermined percentage above an average WOB; and assigning, when in WOB control mode, a value to a second ROP setpoint that is a predetermined percentage above an average ROP.

The present disclosure also provides a system, including: a non-transitory computer readable medium having stored thereon a plurality of instructions, wherein the instructions are executed with one or more processors so that the following steps are executed: (a) accessing a target slide score to be obtained during a slide drill segment; wherein the target slide score is associated with a target tool face; (b) performing, using a bottom hole assembly ("BHA"), a first portion of the slide drill segment in a ramping mode; wherein performing, using the BHA, the first portion of the slide drill segment in ramping mode includes: (c) receiving first downhole data from the BHA during the first portion of the slide drill segment; (d) calculating, based on the first downhole data and the target tool face, an actual slide score; (e) comparing the actual slide score with the target slide score; (f) increasing or decreasing, based on the comparison of step (e), a rate of penetration ("ROP") setpoint; and (g) repeating steps (c)-(f) until a first condition is achieved; and (h) performing, using the BHA and after the achievement of the first condition, a second portion of the slide drill segment in either: a ROP control mode; or a weight on bit ("WOB") control mode. In one or more embodiments, the first condition is the target slide score. In one or more embodiments, the second portion of the slide drill segment is performed in ROP control mode; and performing the second portion of the slide drill segment in ROP control mode includes: (i) identifying a second ROP setpoint associated with the achievement of the first condition; (j) receiving second downhole data from the BHA during the second portion of the slide drill segment; (k) calculating, based on the second downhole data associated with the second portion, a first plurality of metrics; (l) comparing the first plurality of metrics with a plurality of constraints; (m) increasing or decreasing, based on the comparison of step (l), the second ROP setpoint; and (n) repeating steps (j)-(m) until a second condition is achieved. In one or more embodiments, the second ROP setpoint is an average ROP when step (i) is executed. In one or more embodiments, the first condition includes receipt of a first user selection including a selection of the ROP control mode; and the second condition includes receipt of a second user selection including a selection of the WOB control mode. In one or more embodiments, the second portion of the slide drill segment is performed in WOB control mode; and performing the second portion of the slide drill segment in WOB control mode includes: (i) identify a WOB setpoint associated with the achievement of the first condition; (j) receiving second downhole data from the BHA during the second portion of the slide drill segment; (k) calculating, based on the second downhole data associated with the second portion, a first plurality of metrics; (l) comparing the first plurality of metrics with the plurality of constraints; (m) increasing or decreasing, based on the comparison of step (l), the WOB setpoint; and (n) repeating steps (j)-(m) until a second condition is achieved. In one or more embodiments, the target slide score includes a range of acceptable slide scores; step (e) further includes determining that the actual slide score is within the range of acceptable slide scores of the target slide score; and step (f) further includes increasing, based on the determination that the actual slide score is within the range of acceptable slide scores of the target slide score, the ROP setpoint. In one or more embodiments, step (h) includes: assigning, when in ROP control mode, a value to a WOB setpoint that is a predetermined percentage above an average WOB; and assigning, when in WOB control mode, a value to a second ROP setpoint that is a predetermined percentage above an average ROP.

It is understood that variations may be made in the foregoing without departing from the scope of the present disclosure.

In several embodiments, one or more of the operational steps in each embodiment may be omitted. Moreover, in some instances, some features of the present disclosure may be employed without a corresponding use of the other features. Moreover, one or more of the embodiments disclosed above, or variations thereof, may be combined in whole or in part with any one or more of the other embodiments described above, or variations thereof.

Although several embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A method comprising:

(a) accessing a target slide score to be obtained during a slide drill segment;

wherein the target slide score is associated with a target tool face;

(b) performing, using a bottom hole assembly ("BHA"), a first portion of the slide drill segment in a ramping mode;

wherein performing, using the BHA, the first portion of the slide drill segment in ramping mode comprises:

(c) receiving, by a control system, first downhole data from the BHA during the first portion of the slide drill segment, the first downhole data including a plurality of consecutive actual tool face orientations;

(d) calculating, by the control system, an actual slide score by comparing the plurality of consecutive actual tool face orientations with the target tool face;

(e) comparing, by the control system, the actual slide score with the target slide score;

(f) increasing or decreasing, based on the comparison of step (e), a rate of penetration ("ROP") setpoint; and (g) repeating steps (c)-(f) until a first condition is achieved; and (h) performing, using the BHA and after the achievement of the first condition, a second portion of the slide drill segment in either:

a ROP control mode; or a weight on bit ("WOB") control mode.

2. The method of claim 1, wherein the first condition includes the actual slide score being equal to the target slide score.

3. The method of claim 1, wherein the second portion of the slide drill segment is performed in ROP control mode; and wherein performing the second portion of the slide drill segment in ROP control mode comprises:

(i) identifying a second ROP setpoint associated with the achievement of the first condition;

(j) receiving, by the control system, second downhole data from the BHA during the second portion of the slide drill segment;

(k) calculating, by the control system and based on the second downhole data associated with the second portion, a first plurality of metrics;

(l) comparing, by the control system, the first plurality of metrics with a plurality of constraints;

(m) increasing or decreasing, based on the comparison of step (l), the second ROP setpoint; and (n) repeating steps (j)-(m) until a second condition is achieved.

4. The method of claim 3, wherein the second ROP setpoint is based on a historical ROP from the performance of the first portion of the slide drill segment.

5. The method of claim 3, wherein the first condition includes receipt, by the control system, of a first selection including a selection of the ROP control mode; and wherein the second condition includes receipt, by the control system, of a second selection including a selection of the WOB control mode.

6. The method of claim 1, wherein the second portion of the slide drill segment is performed in WOB control mode; and wherein performing the second portion of the slide drill segment in WOB control mode comprises:

(i) identify a WOB setpoint associated with the achievement of the first condition;

(j) receiving, by the control system, second downhole data from the BHA during the second portion of the slide drill segment;

(k) calculating, by the control system and based on the second downhole data associated with the second portion, a first plurality of metrics;

(l) comparing, by the control system, the first plurality of metrics with a plurality of constraints;

(m) increasing or decreasing, based on the comparison of step (l), the WOB setpoint; and (n) repeating steps (j)-(m) until a second condition is achieved.

7. The method of claim 6, wherein increasing the WOB setpoint comprises increasing the WOB setpoint by a predetermined value.

8. The method of claim 7, wherein the predetermined value is based on a ratio.

9. The method of claim 8, wherein the ratio is a change in an average ROP over the change in an average WOB.

10. The method of claim 6, further comprising:

(o) performing, using the BHA and after the achievement of the second condition, a third portion of the slide drill segment in ROP control mode;

wherein performing the third portion of the slide drill segment in ROP control mode comprises:

(p) identifying a second ROP setpoint associated with the achievement of the second condition;

(q) receiving, by the control system, third downhole data from the BHA during the third portion of the slide drill segment;

(r) calculating, by the control system and based on the third downhole data associated with the third portion, a second plurality of metrics;

(s) comparing, by the control system, the second plurality of metrics with the plurality of constraints;

(t) increasing or decreasing, based on the comparison of step(s), the second ROP setpoint; and (u) repeating steps (q)-(t) until a third condition is achieved.

11. The method of claim 1, wherein the target slide score includes a range of acceptable slide scores;

wherein step (e) further comprises determining that the actual slide score is within the range of acceptable slide scores of the target slide score; and wherein step (f) further comprises increasing, based on the determination that the actual slide score is within the range of acceptable slide scores of the target slide score, the ROP setpoint.

12. The method of claim 1, wherein, when in ROP control mode:

a second ROP setpoint is a controlling parameter associated with the performance of the second portion of the slide drill segment;

a WOB setpoint is a non-controlling parameter associated with the performance of the second portion of the slide drill segment; and step (h) comprises continuously assigning a value to the non-controlling parameter that is a predetermined percentage above a running average WOB such that the non-controlling parameter does not interfere with an ability of the controlling parameter to control the performance of the second portion of the slide drill segment; and wherein, when in WOB control mode:

the WOB setpoint is the controlling parameter associated with the performance of the second portion of the slide drill segment;

the second ROP setpoint is the non-controlling parameter associated with the performance of the second portion of the slide drill segment; and step (h) comprises continuously assigning a value to the non-controlling parameter that is a predetermined percentage above a running average ROP such that the non-controlling parameter does not interfere with the ability of the controlling parameter to control the performance of the second portion of the slide drill segment.

13. The method of claim 1, wherein step (f) further comprises increasing the ROP setpoint when the actual slide score is within a predetermined threshold associated with the target slide score.

14. A system, comprising:

a non-transitory computer readable medium having stored thereon a plurality of instructions, wherein the instructions are executed with one or more processors so that the following steps are executed:

(a) accessing a target slide score to be obtained during a slide drill segment;

wherein the target slide score is associated with a target tool face;

(b) performing, using a bottom hole assembly ("BHA"), a first portion of the slide drill segment in a ramping mode;

wherein performing, using the BHA, the first portion of the slide drill segment in ramping mode comprises:

(c) receiving first downhole data from the BHA during the first portion of the slide drill segment, the first downhole data including a plurality of consecutive actual tool face orientations;

(d) calculating an actual slide score by comparing the plurality of consecutive actual tool face orientations with the target tool face;

(e) comparing the actual slide score with the target slide score;

(f) increasing or decreasing, based on the comparison of step (e), a rate of penetration ("ROP") setpoint; and (g) repeating steps (c)-(f) until a first condition is achieved; and (h) performing, using the BHA and after the achievement of the first condition, a second portion of the slide drill segment in either:

a ROP control mode; or a weight on bit ("WOB") control mode.

15. The system of claim 14, wherein the first condition is the target slide score.

16. The system of claim 14, wherein the second portion of the slide drill segment is performed in ROP control mode;

wherein performing the second portion of the slide drill segment in ROP control mode comprises:

(i) identifying a second ROP setpoint associated with the achievement of the first condition;

(j) receiving second downhole data from the BHA during the second portion of the slide drill segment;

(k) calculating, based on the second downhole data associated with the second portion, a first plurality of metrics;

(l) comparing the first plurality of metrics with a plurality of constraints;

(m) increasing or decreasing, based on the comparison of step (l), the second ROP setpoint; and (n) repeating steps (j)-(m) until a second condition is achieved.

17. The system of claim 16, wherein the second ROP setpoint is an average ROP when step (i) is executed.

18. The system of claim 16, wherein the first condition includes receipt of a first user selection including a selection of the ROP control mode; and wherein the second condition includes receipt of a second user selection including a selection of the WOB control mode.

19. The system of claim 14, wherein the second portion of the slide drill segment is performed in WOB control mode; and wherein performing the second portion of the slide drill segment in WOB control mode comprises:

(i) identify a WOB setpoint associated with the achievement of the first condition;

(j) receiving second downhole data from the BHA during the second portion of the slide drill segment;

(k) calculating, based on the second downhole data associated with the second portion, a first plurality of metrics;

(l) comparing the first plurality of metrics with a plurality of constraints;

(m) increasing or decreasing, based on the comparison of step (l), the WOB setpoint; and (n) repeating steps (j)-(m) until a second condition is achieved.

20. The system of claim 14, wherein the target slide score includes a range of acceptable slide scores;

wherein step (e) further comprises determining that the actual slide score is within the range of acceptable slide scores of the target slide score; and wherein step (f) further comprises increasing, based on the determination that the actual slide score is within the range of acceptable slide scores of the target slide score, the ROP setpoint.

21. The system of claim 14, wherein, when in ROP control mode:

a second ROP setpoint is a controlling parameter associated with the performance of the second portion of the slide drill segment;

a WOB setpoint is a non-controlling parameter associated with the performance of the second portion of the slide drill segment; and step (h) comprises continuously assigning a value to the non-controlling parameter that is a predetermined percentage above a running average WOB such that the non-controlling parameter does not interfere with an ability of the controlling parameter to control the performance of the second portion of the slide drill segment; and wherein, when in WOB control mode:

the WOB setpoint is the controlling parameter associated with the performance of the second portion of the slide drill segment;

the second ROP setpoint is the non-controlling parameter associated with the performance of the second portion of the slide drill segment; and step (h) comprises continuously assigning a value to the non-controlling parameter that is a predetermined percentage above a running average ROP such that the non-controlling parameter does not interfere with the ability of the controlling parameter to control the performance of the second portion of the slide drill segment.

22. The system of claim 14, wherein step (f) further comprises increasing the ROP setpoint when the actual slide score is within a predetermined threshold associated with the target slide score.

* * * * *